US005944253A

United States Patent [19]

Miller et al.

[11] Patent Number: 5,944,253

[45] **Date of Patent: *Aug. 31, 1999**

[54] SLEEVE STYLE BOTTLE CARTON

[75] Inventors: Charles A. Miller, Williamsburg, Ohio; Norbert Hoell, Southgate, Ky.

[73] Assignee: The C. W. Zumbiel Co., Cincinnati, Ohio

[ * ] Notice: This patent is subject to a terminal disclaimer.

[21] Appl. No.: 08/925,969

[22] Filed: Sep. 9, 1997

Related U.S. Application Data

[63] Continuation-in-part of application No. 08/797,882, Feb. 10, 1997.

[51] Int. Cl.[6] ..... B65D 3/00

[52] U.S. Cl. ..... 229/182.1; 229/103.2; 206/145; 206/429; 206/153; 206/459.5

[58] Field of Search ..... 206/145, 459.1, 206/140, 459.5, 147, 429, 427, 433, 152, 153; 229/182.1, 103.2

[56] References Cited

U.S. PATENT DOCUMENTS

| | | | |
|---|---|---|---|
| D. 259,104 | 5/1981 | Calvert . | |
| D. 316,672 | 5/1991 | Wood . | |
| D. 319,388 | 8/1991 | McIntosh, Jr. . | |
| D. 332,915 | 2/1993 | Hoell et al. . | |
| D. 372,861 | 8/1996 | Hoell et al. . | |
| 3,269,531 | 8/1966 | Weiss | 206/152 |
| 3,652,005 | 3/1972 | Morgese | 206/434 |
| 4,398,631 | 8/1983 | Graser . | |
| 4,784,316 | 11/1988 | Crouch . | |
| 4,919,266 | 4/1990 | McIntosh, Jr., et al. | 206/434 |
| 4,925,019 | 5/1990 | Ganz et al. | 206/427 X |
| 5,106,014 | 4/1992 | Miller . | |
| 5,197,598 | 3/1993 | Stout et al. . | |
| 5,197,656 | 3/1993 | Hoell et al. . | |
| 5,246,112 | 9/1993 | Stout et al. . | |
| 5,381,948 | 1/1995 | Coalier et al. | 229/109 |
| 5,538,133 | 7/1996 | Campbell et al. | 206/153 X |
| 5,551,556 | 9/1996 | Sutherland | 206/427 X |
| 5,692,614 | 12/1997 | Harris | 206/429 |

FOREIGN PATENT DOCUMENTS 2698074 10/1992 France .

OTHER PUBLICATIONS

Great Package Design, vol. 2, Rockport Publishers, Allworth Press, 1995.

Package Design, PBC International, Inc., 1983.

*Primary Examiner*—Gary E. Elkins
*Assistant Examiner*—Tri M. Mai
*Attorney, Agent, or Firm*—Wood, Herron & Evans

[57] ABSTRACT

A sleeve style carton for a bottle matrix where the bottles may be either of the short neck type or the long neck type. The carton includes body corner flaps that are wrapped around the bodies of the corner bottles of the matrix. Preferably each body corner flap is of a height not substantially greater than the height of a bottle's label and is positioned so as to substantially overlie that corner bottle's label when the carton is filled with the bottle matrix. This allows label indicia to be provided on each body corner flap that simulates that portion of the bottle's label indicia visible when the bottle's label is viewed on the bottle in front plan view, thereby making it appear to a casual observer that the bottle's label itself is being viewed in front plan view when the bottle matrix is in the carton regardless of the rotational position of the corner bottles relative to the matrix. The carton also includes head corner flaps that are wrapped around the heads of the corner bottles of the matrix, in preferred form the head corner flaps and head end flap panels on the one hand, and body corner flaps and floor end flap panels on the other hand, being configured and located so as to define a window at each end of the carton that extends across the entire width of the carton and through which the end bottles' neck and shoulder portions can be seen when the carton is viewed in end elevation view.

31 Claims, 16 Drawing Sheets

SLEEVE STYLE BOTTLE CARTON

This application is a continuation-in-part application based on U.S. Ser. No. 08/797,882 filed Feb. 10, 1997 entitled Sleeve Style Bottle Carton.

This invention relates to cartons. More particularly, this invention relates to sleeve style cartons particularly adapted for use with bottles, whether of the short neck or long neck type.

Cartons are widely used in the beverage industry in the marketing of beverage products, e.g., beer and soft drinks. Such products are commonly marketed in bottles. These bottles are of two basic types, i.e., short neck bottles commonly used for soft drinks and long neck bottles commonly used for beer. These beer and soft drink bottles are often distributed in cartons of one kind or another, the bottles being oriented within the carton in a bottle matrix configuration, e.g., eight bottles or twelve bottles or the like.

It has been one objective of this invention to provide an improved sleeve style carton particularly adapted for use with a bottle matrix where the bottle matrix is relatively tightly wrapped about the circumference of the matrix so that jostling or movement of the bottles within the carton package is minimized as the carton is handled throughout the distribution chain from the bottler to the retail consumer.

It has been another objective of this invention to provide an improved sleeve style carton for a bottle matrix a s described above which incorporates a body corner flap at each corner of the carton, each body corner flap being adapted to wrap around its associated corner bottle's body so as to relatively tightly wrap or tighten the bottles in the bottle matrix one with another, being of a height not substantially greater than the height of its associated corner bottle's label, and being sized and positioned to overlie its associated corner bottle's label so as to cooperate in defining a window at each corner of the carton through which the necks and/or shoulders of the corner bottles are exposed to a casual viewer when the carton is viewed in side or end elevation view.

It has been a further objective of this invention to provide an improved sleeve style carton for a bottle matrix of the type described above where the body corner flaps are each provided with label indicia that simulates the bottle label indicia visible when the bottle's label is viewed on the bottle in front plan view, so as to cooperate in presenting an impression to a casual observer that the corner bottles as packaged in the carton each indeed appear simply as same might appear in front elevation view separate of the package when the corner of the carton is viewed in elevation along a sight line analogous to the front elevation of the bottle by itself even though the bottle labels are at least partially covered by the body corner flaps.

It has been still another objective of this invention to provide an improved sleeve style carton for use with a bottle matrix which incorporates a head corner flap at each corner of the carton, each head corner flap being adapted to wrap around its associated corner bottle's head, and being of a height not substantially greater then the height of its associated corner bottle's head, so as to cooperate in defining a window at each end of the carton which extends across the entire width of the carton and through which the necks and/or shoulders of all bottles at each end of the carton can be seen when the carton is viewed in end elevation view.

Other objectives and advantages of this invention will be more apparent from the following detailed description taken in conjunction with the drawings in which.

Figure 1:
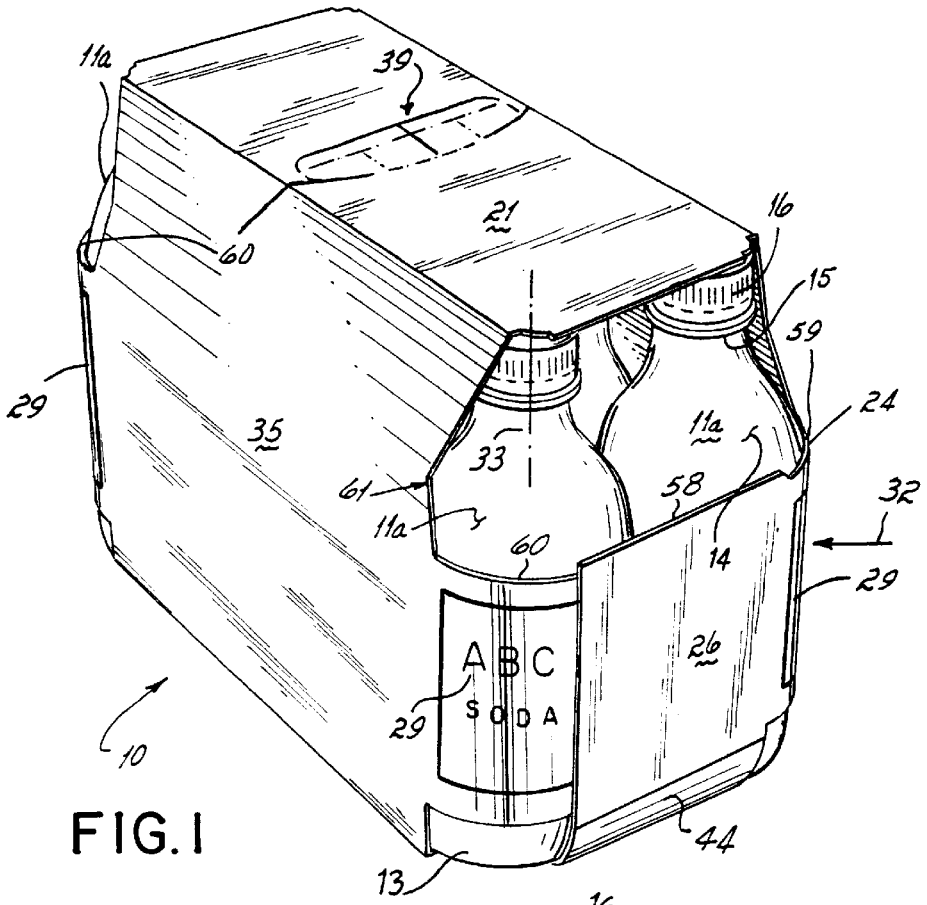
FIG. 1 is a perspective view of a first embodiment of a sleeve style bottle carton in accord with the principles of this invention, same being illustrated in final or assembled or package form with a bottle matrix of short neck bottles.
Figure 2:
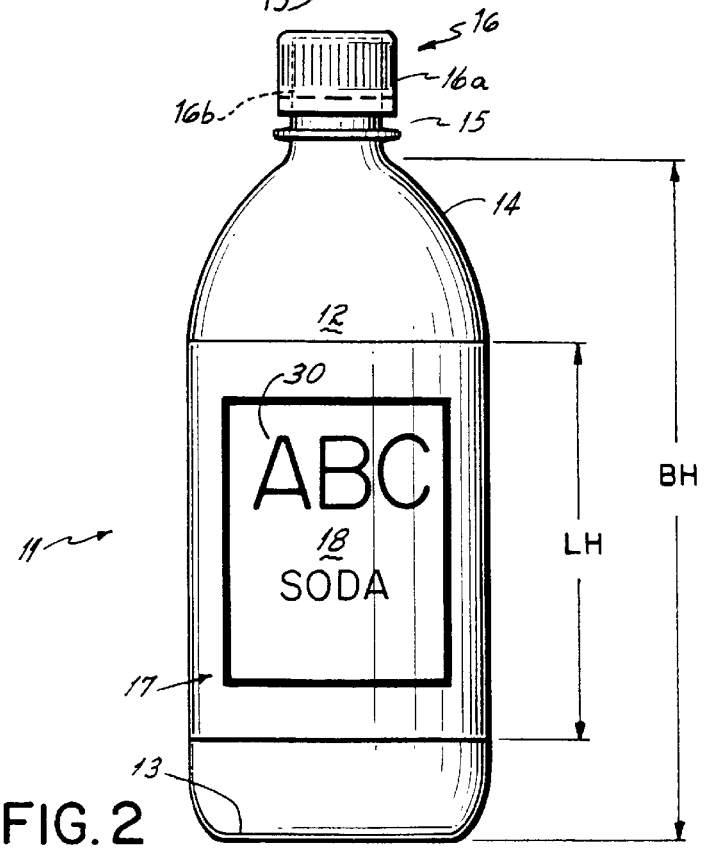
FIG. 2 is a front elevation view of a short neck bottle of the type used with the FIG. 1 carton.

The first embodiment 10 of the sleeve style bottle carton of this invention, as shown in FIG. 1, is particularly structured for use with bottles 11 of the short neck type, as shown in FIG. 2. The short neck bottle 11 has a body 12, a heel 13, a shoulder 14, a short neck 15 and a head 16 that includes cap 16*a* and mouth 16*b*. A label 17 is provided on the bottle's body 12, either printed directly on the body or provided on a separate substrate attached to the body. The label 17 may extend either partially or wholly around the bottle's periphery. The label 17 has a front section 18 (e.g., printed with the beverage's name and/or logo) that is apparent to the bottle's viewer when the bottle's label is viewed on the bottle in front elevation view as shown in FIG. 2, and it is this front section 18 which the beverage manufacturer desires to have the greatest visual impact on the bottle's prospective purchaser. Note the label height LH of the label in the embodiment shown is less than the body height BH of the bottle.

Figure 3:
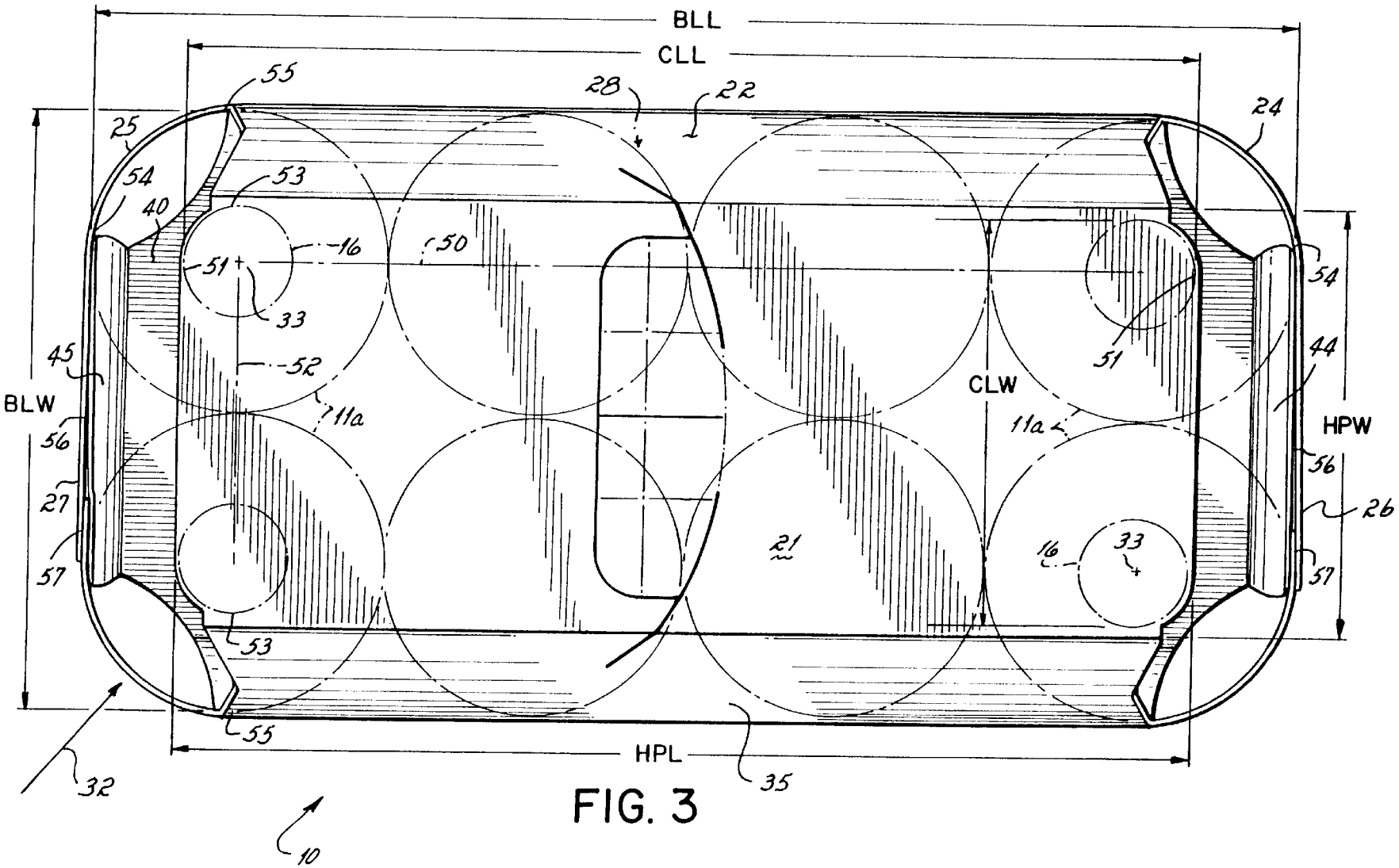
FIG. 3 is a top plan view of the short neck bottle carton of FIG. 1.
Figure 4:
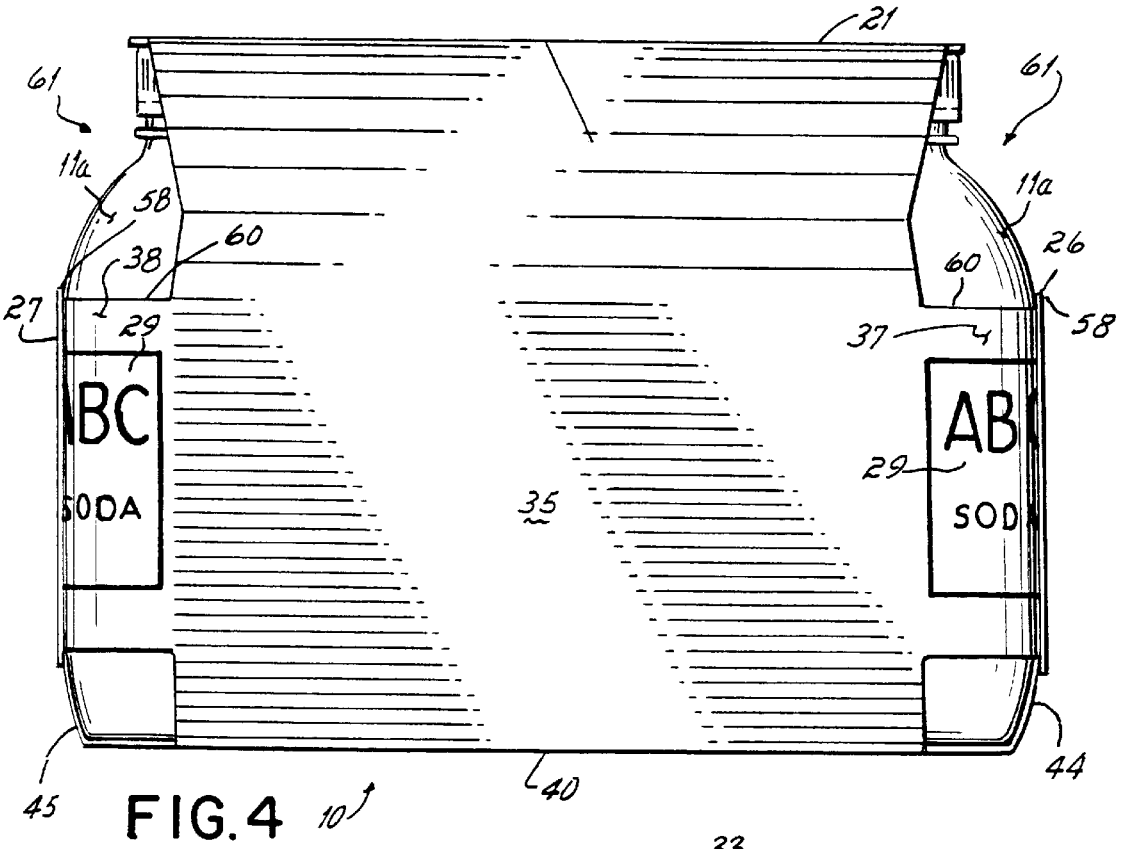
FIG. 4 is a side elevation view of the short neck bottle carton of FIG. 1.
Figure 5:
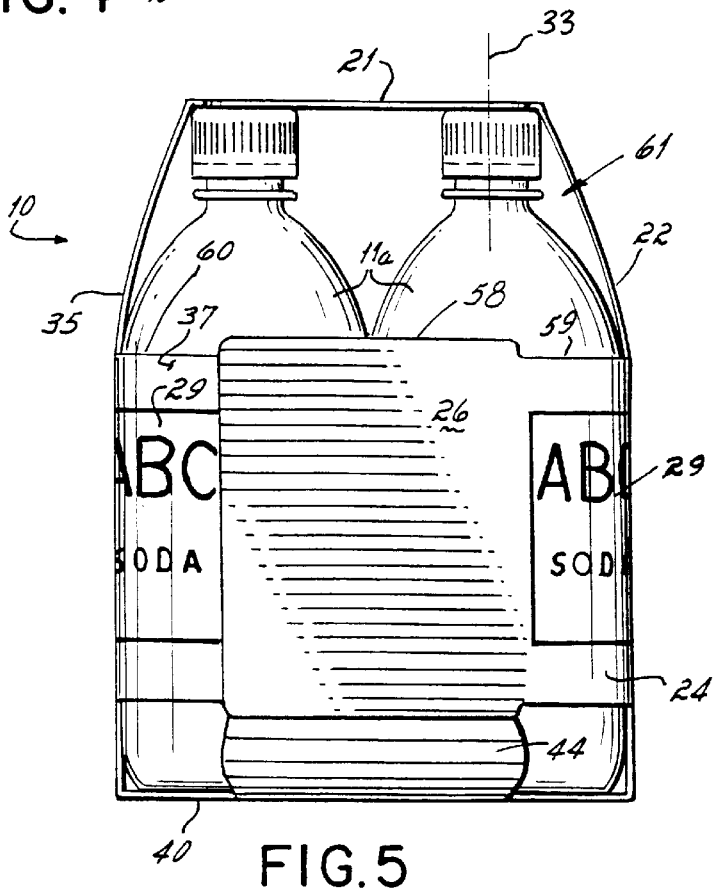
FIG. 5 is an end elevation view of the short neck bottle carton shown in FIG. 1.
Figure 6:
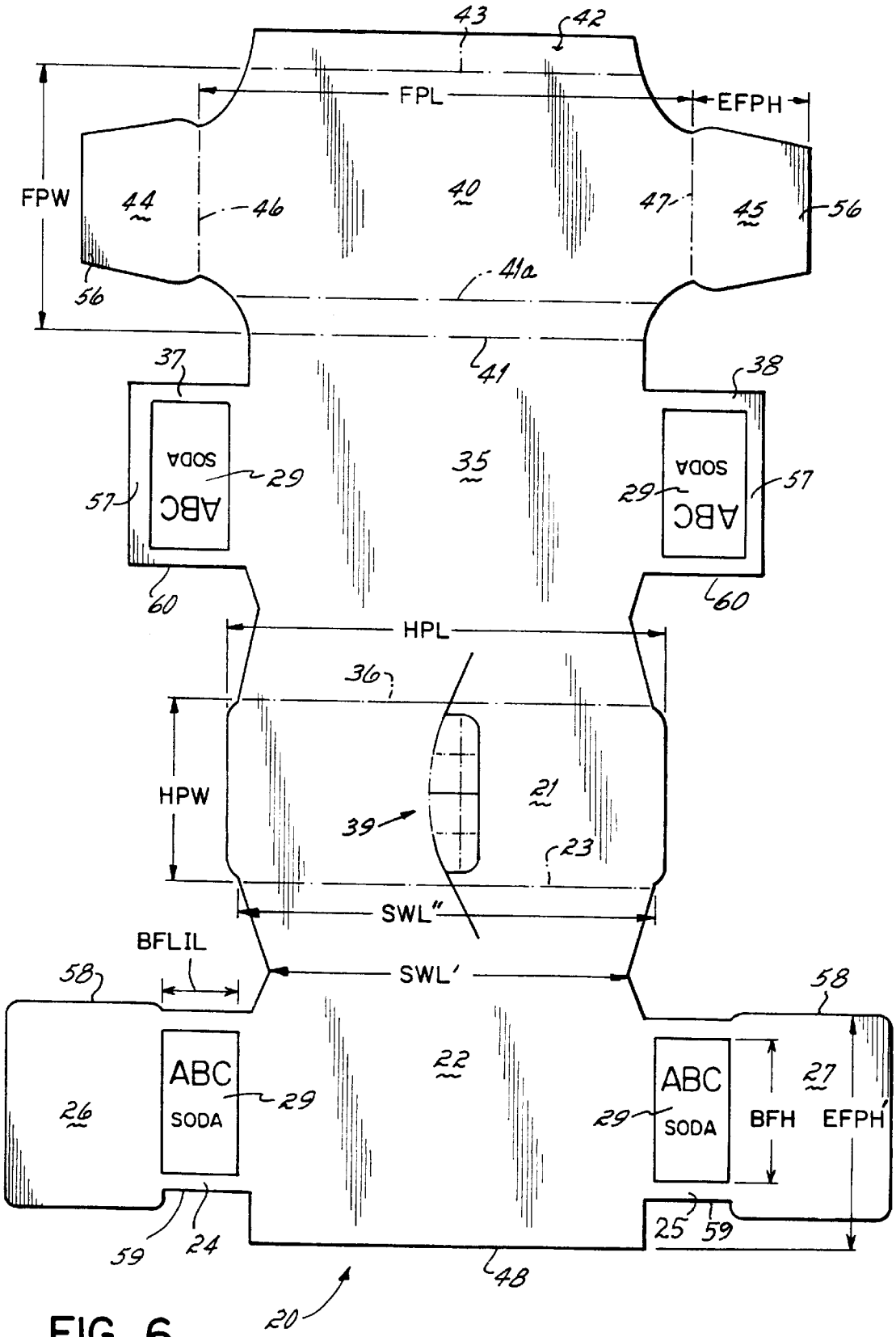
FIG. 6 is a top plan view of a carton blank for the sleeve style short neck bottle carton shown in FIG. 1, and in accord with the principles of this invention.

A sleeve style carton blank 20 for short neck bottles 11 of the type shown in FIG. 2, and in accord with the principles of this invention, is illustrated in FIG. 6. As shown there, the carton blank 20 is comprised of a head panel 21 having a first side wall panel 22 connected on fold line 23 along one side edge thereof. A body corner flap 24, 25 is formed integral with each of opposed ends of that first side wall panel 22, and a side end flap panel 26, 27 is formed integral with and extends outwardly from each body corner flap. Each body corner flap 24, 25 is of a flap height BFH not substantially greater than the label height LH of a corner bottle's label 17, and is positioned relative to the first side wall panel 22 so as to substantially overlie that corner bottle's label when the carton 10 is filled with a bottle matrix 28, as shown in FIG. 3. This allows the corner bottle's head 16, neck 15, shoulder 14, and the corner bottle's heel 13, to be partially visible when the carton 10 is filled with the bottle matrix and is viewed in side or end elevation view, see FIGS. 1, 4 and 5. Further, flap label indicia 29 is provided on each of the body corner flaps 24, 25, that indicia being such as to simulate a portion of the bottle label indicia 30 provided on the bottle's label 17. Preferably the flap label indicia 29 simulates that portion of the bottle label indicia 30 that is visible when the bottle label 17 is viewed on the bottle in front plan view as shown in FIG. 2, i.e., the front section 18 of the bottle label. And again preferably, the flap label indicia 29 provided on the body corner flaps 24, 25 is visually distinct from the graphics and/or advertising copy provided on the adjacent side end flap 26, 27 and side wall 22 panels. The purpose here is one of providing a commercial impression on body corner flaps 24, 25 to a prospective retail consumer which allows that prospective consumer to think for a moment upon first viewing the corner bottles 11*a* in the carton 10 that same indeed are the bottles themselves and not the carton's body corner flaps 24, 25 that the viewer is actually seeing. A further advantage from a commercial distribution standpoint is that regardless of the rotational position of the corner bottle 1 la itself in the corner of the carton 10, it always appears to the prospective customer that the corner bottle is turned precisely so that the bottle label's front section 18 is seen by the viewer when the corner of the carton is viewed in elevation along a line of sight 32 analogous to the front elevation of the bottle itself even if the bottle itself in fact is turned or rotated relative to its longitudinal center axis 33 so that the bottle label's rear face (not shown) is at the corner. Accordingly, the body corner flaps 24, 25 are provided with label indicia 29 that simulates the front section 18 of a bottle's label 17 so it always appears to the casual viewer that the corner bottles 11*a* in the carton 10 are oriented with their labels' front sections facing outward toward the prospective customer whether that in fact is the case or not. So in this regard, each body corner flap 24, 25 is provided with flap label indicia 29 and a flap label indicia length BFLIL which is of a length no greater than about one quarter the peripheral length of the corner bottle 11*a*. Also, each body corner flap 24, 25 is provided with a flap height BFH sufficient to cover only the corner bottle label 17, i.e., a flap height BFH substantially equal to the label height LH, thereby leaving the bottle's heel 13, shoulder 14, short neck 15 and head 16 visible to the prospective retail customer when the bottle matrix 28 is installed in the closed end carton 10 as shown in FIGS. 1, 4 and 5.

The carton blank 20 for the short neck bottle carton 10 also includes a second side wall panel 35 connected on fold line 36 to the other side edge of the head panel 21. This second side wall panel 35 also includes body corner flaps 37, 38 formed integral therewith at each end. These body corner flaps 37, 38 have the same characteristics as to flap label indicia 29, flap label indicia length BFLIL and flap height BFH as described above for body corner flaps 24, 25. Note this second side wall panel 35, as well as the first side wall panel 22, in that area thereof located above the body corner flaps 37, 38 and 26, 27, is provided with an indented section at the side edges so that the side wall panel length SWL' in this location is less than the side wall panel length SWL" adjacent the head panel 21. This necked-in or indented section of the side wall panels 22, 35 enhances viewing of a corner bottle's shoulder 14, short neck 15 and head 16 when the bottle matrix 28 is installed in the carton 20. In other words, because the necked down length SWL' of each side wall 22, 35 is located at an elevation on the side walls adjacent the corner bottle's shoulders 14 when the carton 10 is erected and filled with the bottle matrix 28, this enlarges the view of each visible corner bottle's neck 15 and shoulder 14 over what would otherwise be the case if the necked down length did not exist, thereby promoting the contents of the carton when loaded with the bottle matrix to the prospective retail customer.

The head panel 21 includes a handle system 39 which forms no part per se of this invention. A detailed disclosure of that handle system 39 is to be found in U.S. Pat. No. 4,784,316, assigned to the assignee of this invention, the detailed description of same being incorporated herein by reference.

The carton blank 20 for short neck bottles 11, as illustrated in FIG. 6, includes a floor panel 40 connected on fold line 41 at the bottom edge of the second side wall panel 35, and a secondary score line 41*a*. The floor panel 40 includes a glue flap 42 connected on fold line 43 along its free side edge. The floor panel 40 further includes floor end flap panels 44, 45 connected on fold lines 46, 47, respectively, to opposite ends of the floor panel. The height EFPH of each floor end flap panel 44, 45, relative to the bottom edge 41 of the second side wall panel 35 is no greater than the height EFPH' of the side end flap panels 26, 27 relative to the bottom edge 48 of the first side wall panel 22.

Note particularly the head panel 21 is of a length HPL not substantially greater than the length CLL of a bottle line 50 of the bottle matrix 28 as measured from outer edge 51 to outer edge of bottle heads 16 on those two bottles 11*a* at opposite ends of the bottle line, and is of a width HPW not substantially greater than the width CLW of a bottle row 52 of the bottle matrix as measured from outer edge 53 to outer edge of bottle caps on those two bottles 11*a* at opposite ends of a bottle row. Note further that the floor panel 40 is of a floor panel length FPL not substantially greater than the length BLL of a bottle line 50 of the bottle matrix 28 as measured from outer edge 54 to outer edge of label sections 17 of those two bottles 11*a* at opposite ends of the bottle line. And the floor panel 40 also has a floor panel width FPW not substantially greater than the width BLW of a bottle row 52 of the bottle matrix 28 as measured from outer edge 55 to outer edge of label sections 17 of those two bottles 11*a* at opposite ends of the bottle row. This floor panel length FPL and floor panel width FPW is substantially greater than the head panel length HPL and head panel width HPW.

Figure 7:
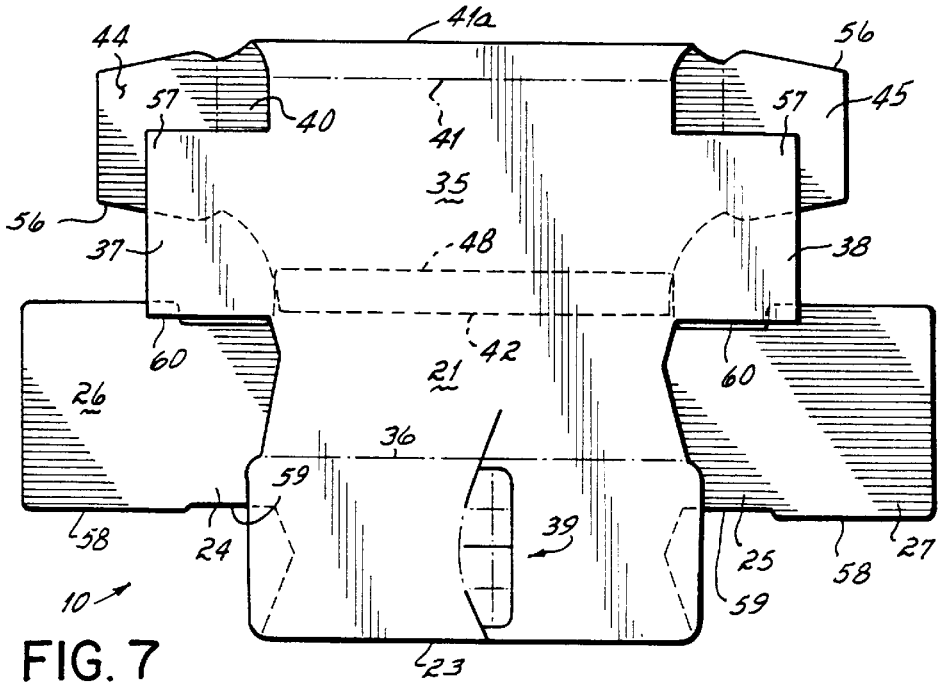
FIG. 7 is a top plan view of the FIG. 6 carton blank in an intermediate assembly step where it is glued into sleeve configuration but is still flattened for shipping.
Figure 8:
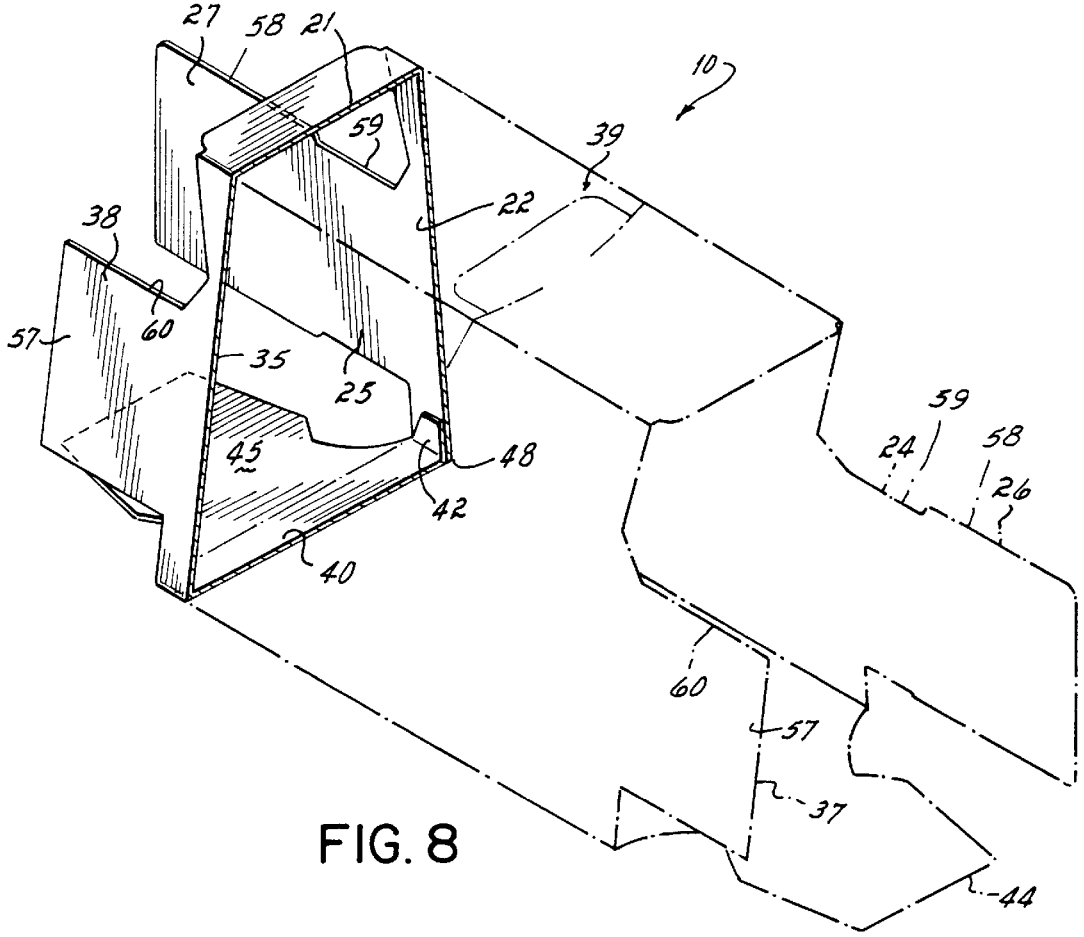
FIG. 8 is a perspective view of the sleeve of FIG. 7 erected prior to filling.
Figure 9:
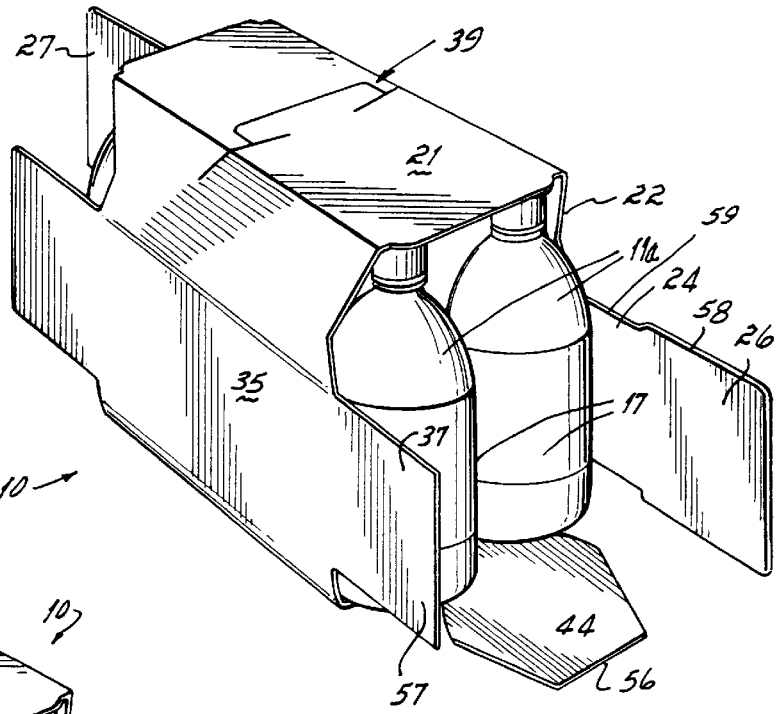
FIG. 9 is a perspective view of the sleeve style short neck bottle carton shown in FIG. 1 with a short neck bottle matrix installed therein prior to closure of the carton.
Figure 10:
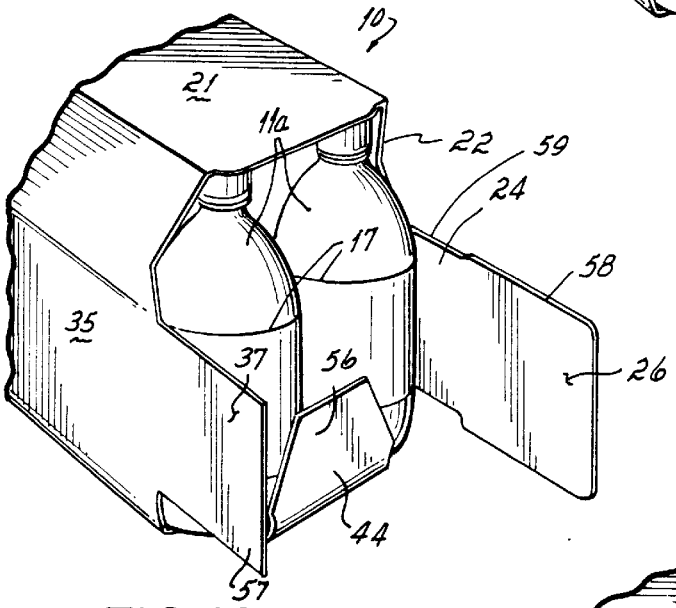
FIG. 10 is a partial perspective view similar to FIG. 9 but illustrating a first intermediate closure step of one end of the short neck bottle carton.
Figure 11:
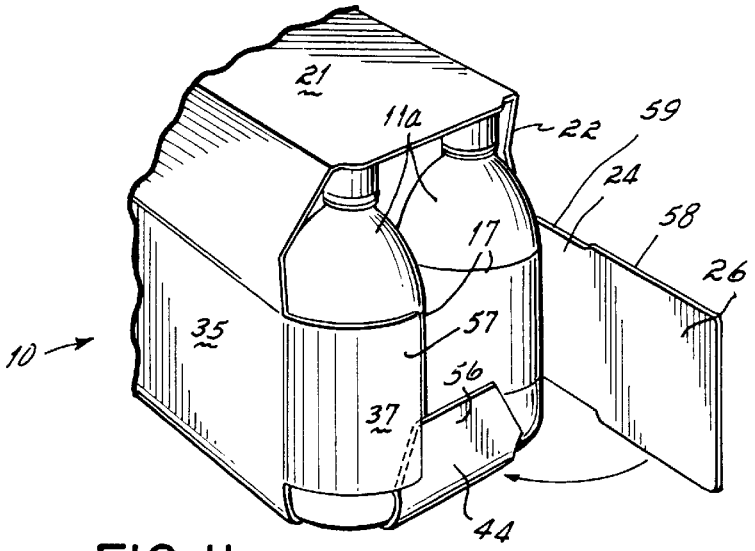
FIG. 11 is a partial perspective view similar to FIG. 10 but illustrating final closure of that one end of the short neck bottle carton.
Figure 12:
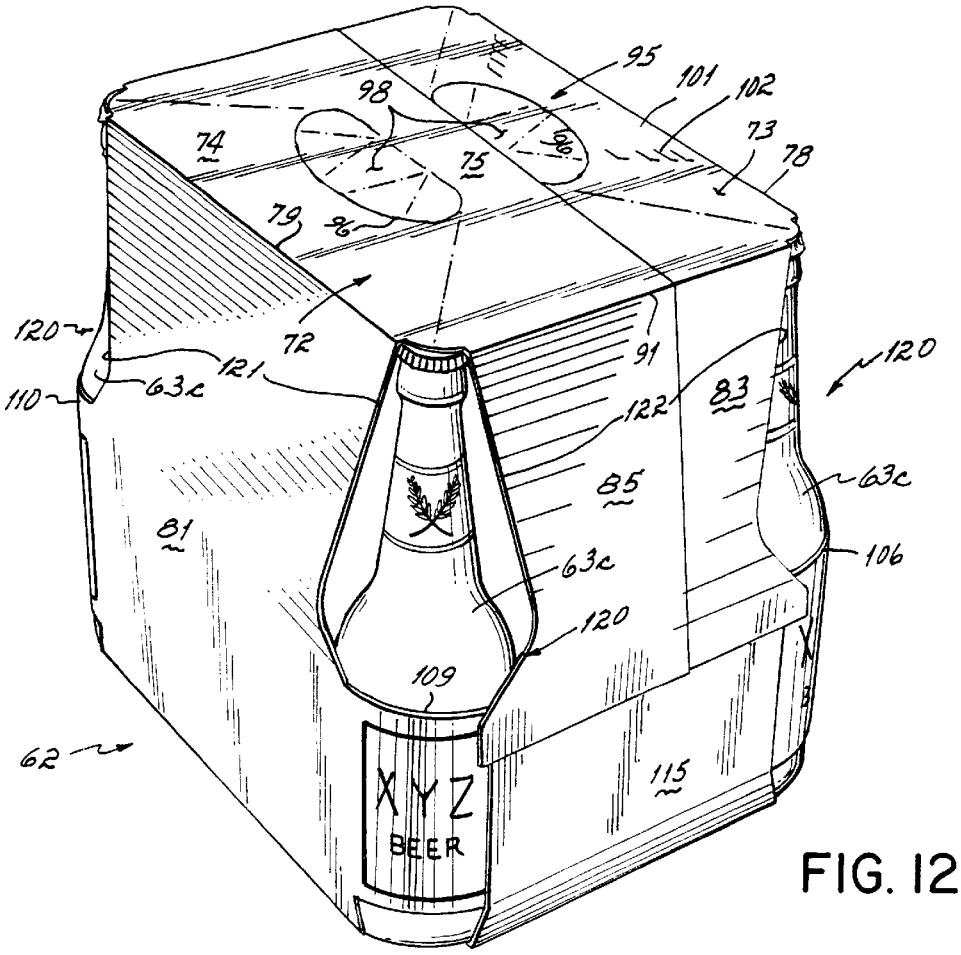
FIG. 12 is a perspective view of a second embodiment of a sleeve style carton in accord with the principles of this invention, same being illustrated in final or assembled or package form with a bottle matrix of long neck bottles.

Use of the sleeve style carton blank 20 shown for short neck bottles 11, and shown in FIG. 6, is illustrated in FIGS. 7–11. First, the glue is applied to the glue flap 42 and then the bottom panel 40 is folded under along fold line 41*a*. Next, the side panel 22 is folded under along the fold line 23 so that the bottom edge 48 is glued to the flap 42. This creates the "sleeve", which is open at both ends, for the sleeve style carton. And this sleeve remains folded flat as shown in FIG. 7 for shipping purposes. Now when the flat folded FIG. 7 carton is received by a bottler, it is erected from the flatted shipping configuration into the open sleeve configuration illustrated in FIGS. 8 and 9, and a short neck bottle matrix 28 inserted as the initial packaging step. Subsequently, and as shown in FIG. 10, bottom flaps 44, 45 are folded up against the end bottles 11*a* and glue is applied to their edges 56. Next, the body corner flaps 37, 38 are wrapped around the corner bottles 11*a* and glue is applied along their marginal edges 57. To complete the package the corner flaps 26, 27 are relatively tightly wrapped around the corner bottles 11*a* to draw the bottles 11 against one another inside the carton 10. This results in the side end flap panels 26, 27 partially overlying the free edges 57 of corner flaps 36, 37, as shown in FIG. 1. Note the top edges 58 of the end flap panel 26, 27, do not extend substantially above the top edges 59, 60 of the corner flaps 24, 25 and 37, 38, respectively. So the ends of the carton 10 thereby each establishes a window 61 above the corner flaps 24, 25, 37, 38 that extends across the entire width of the carton, and through which bottles 11*a* at that end of the carton can be seen when the carton is viewed in end elevation view from that end.

Figure 13:
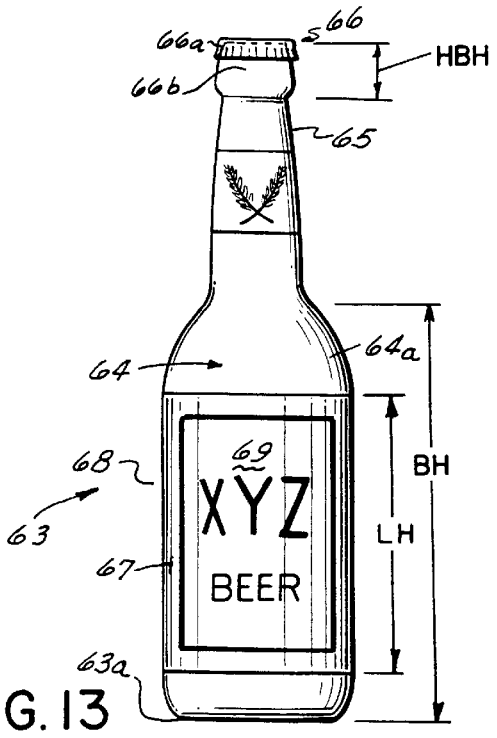
FIG. 13 is a front elevation view of a long neck bottle of the type used with the FIG. 12 carton.
Figure 14:
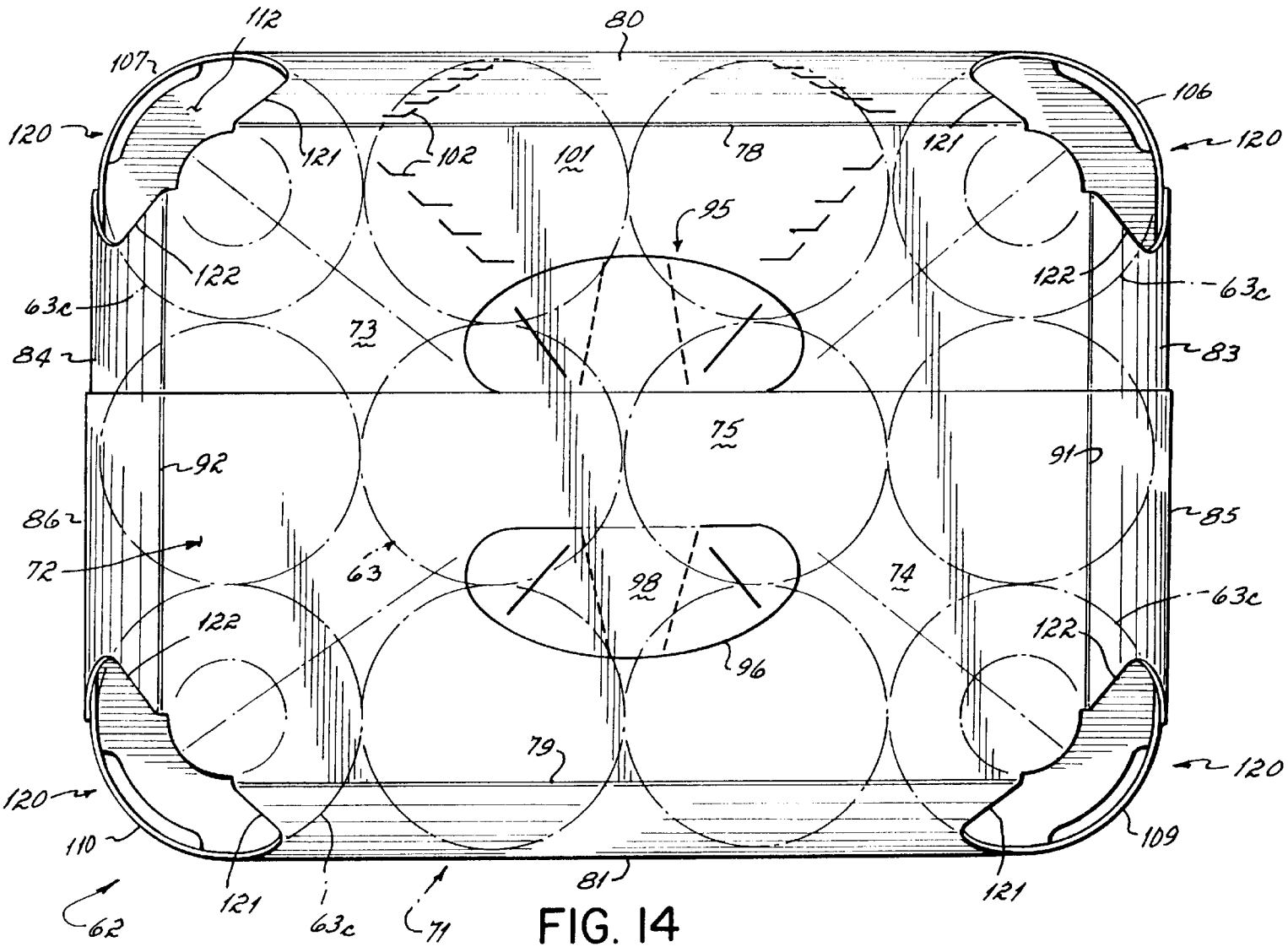
FIG. 14 is a top plan view of the long neck bottle carton of FIG. 1.
Figure 15:
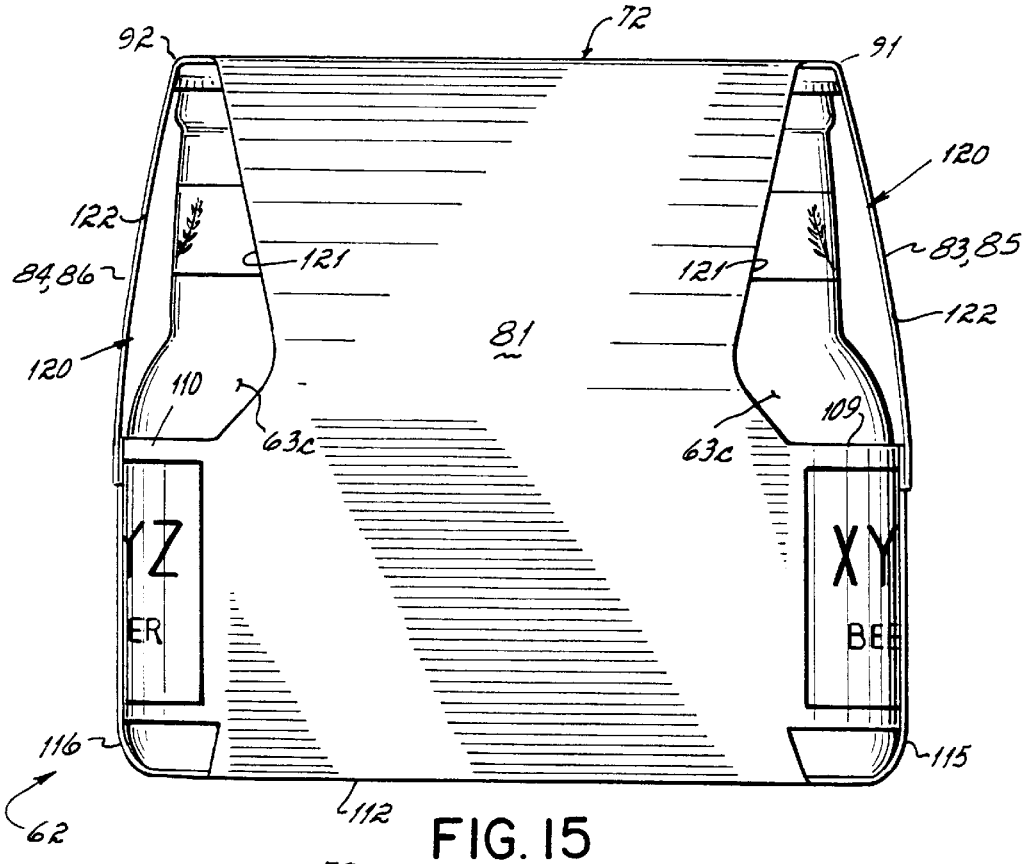
FIG. 15 is a side elevation view of the long neck bottle carton of FIG. 12.
Figure 16:
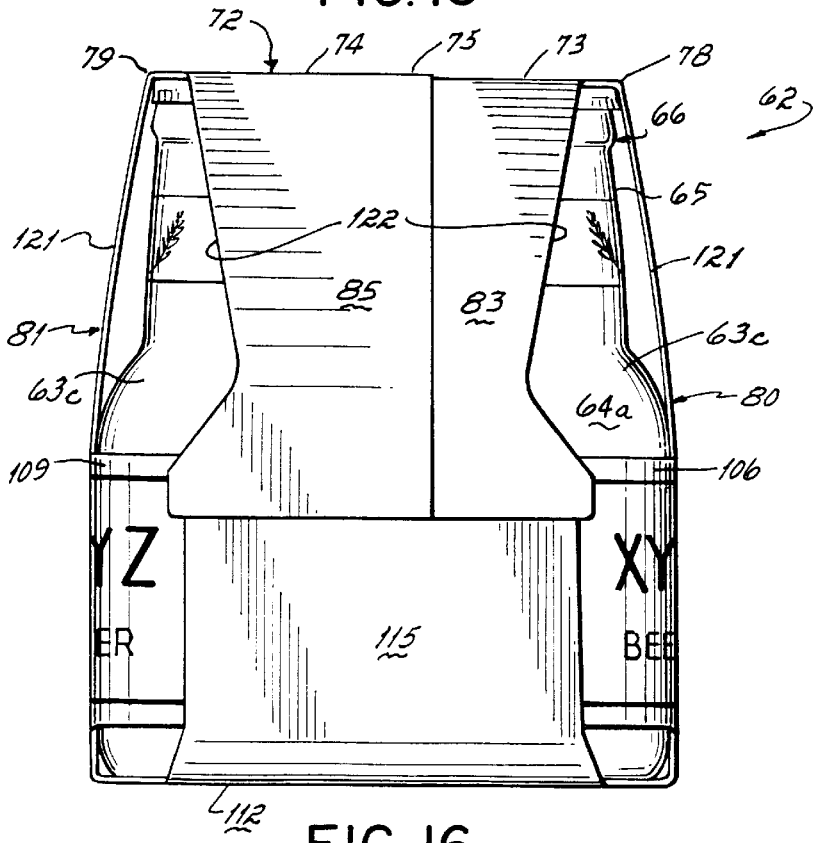
FIG. 16 is an end elevation view of the long neck bottle carton shown in FIG. 12.

A second embodiment of a sleeve style carton 62 of this invention, and particularly structured for use with a long neck bottle 63, e.g., a beer bottle, is illustrated in FIGS. 12–23. Note particularly this long neck beer bottle 63 is of the type having a heel 63*a*, a body 64, a shoulder 64*a*, a long neck 65 and a head 66 that includes a cap 66*a* and a mouth 66*b*. The primary difference between the long neck bottle 63 of this second carton embodiment and the short neck bottle 11 of the first embodiment is in the length of the bottle's neck. The long neck bottle 61 is of a body height BH, and a label 67 of label height LH is located on label section 68 of the body 64, either being printed directly thereon or printed on a separate substrate adhered thereto. The front or main section 69 of the label 67 (which carries the drink name or logo) is visible to a prospective retail customer when the bottle 61 is viewed in front elevation view as shown in FIG. 13.

Figure 17:
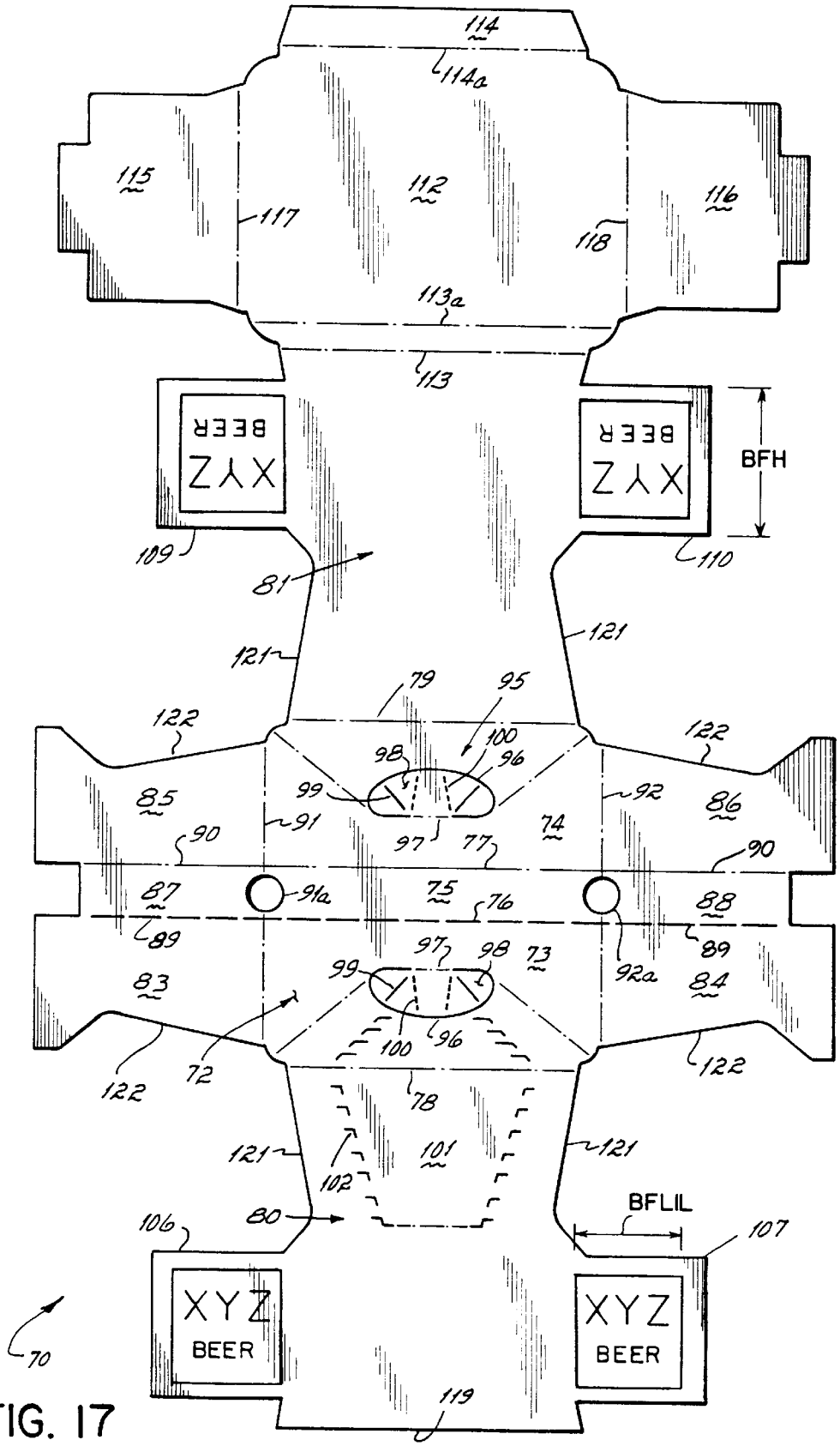
FIG. 17 is a top plan view of a carton blank for the sleeve style long neck bottle carton shown in FIG. 12, and in accord with the principles of this invention.
Figure 18:
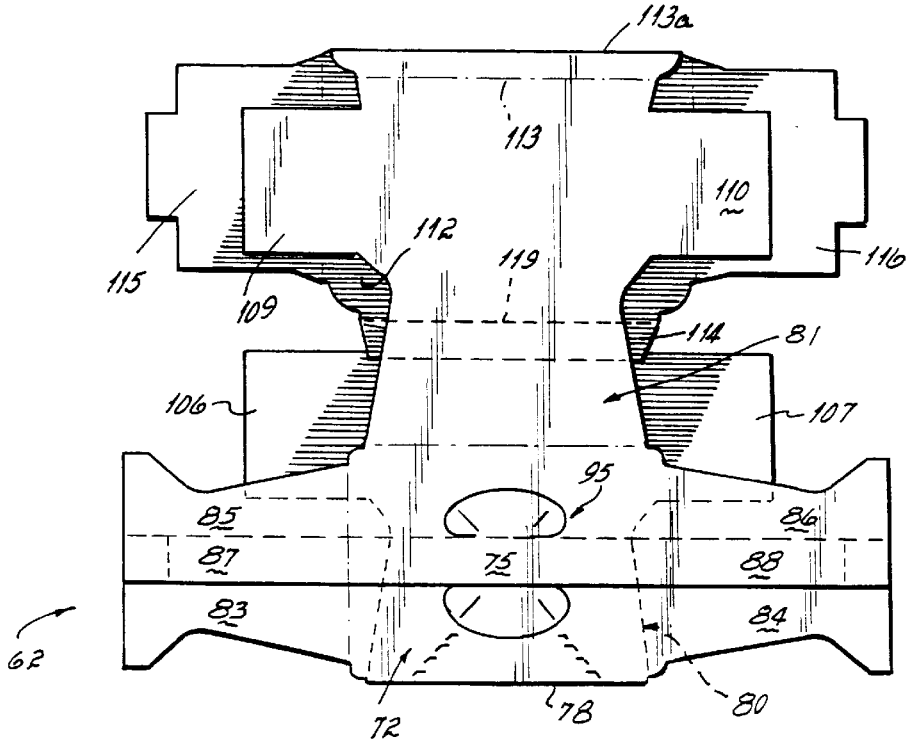
FIG. 18 is a top plan view of the carton blank in an intermediate assembly step where it is glued into sleeve configuration but is still flattened for shipping.
Figure 19:
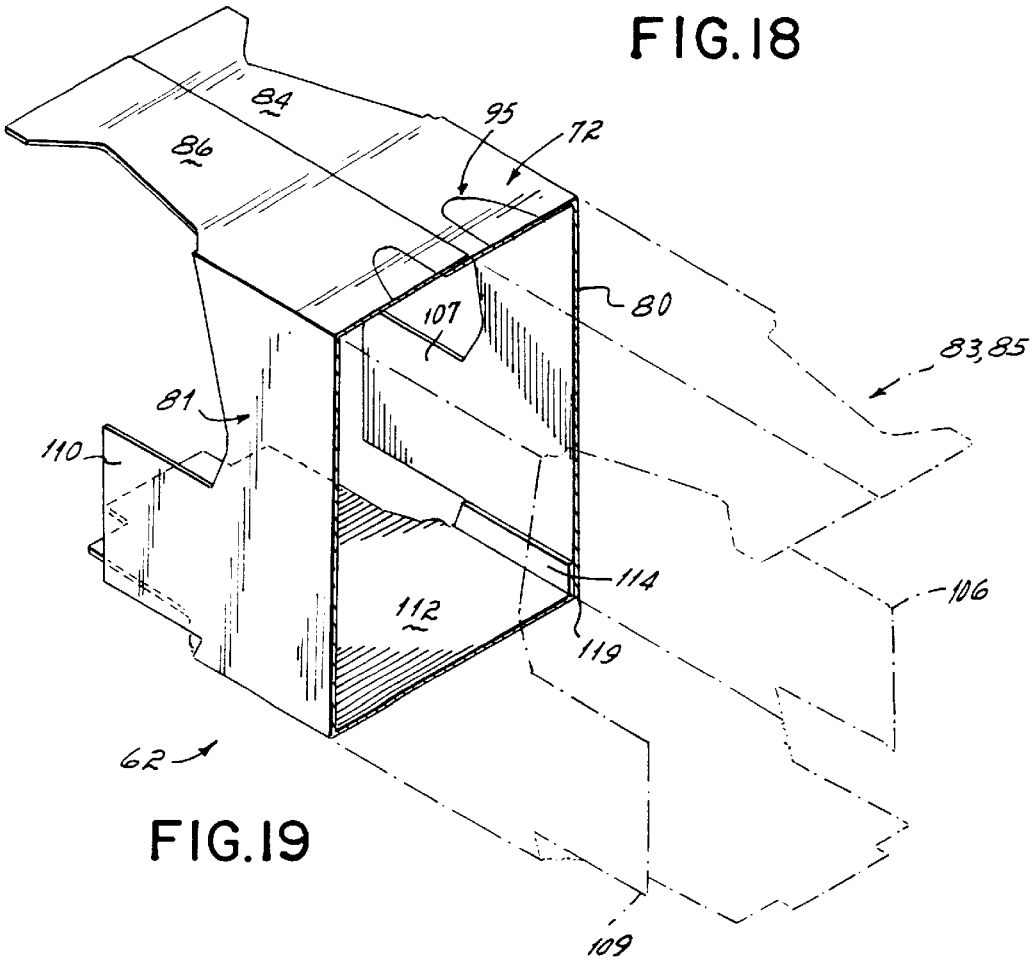
FIG. 19 is a perspective view of the erected sleeve of FIG. 18 partially broken away.
Figure 20:
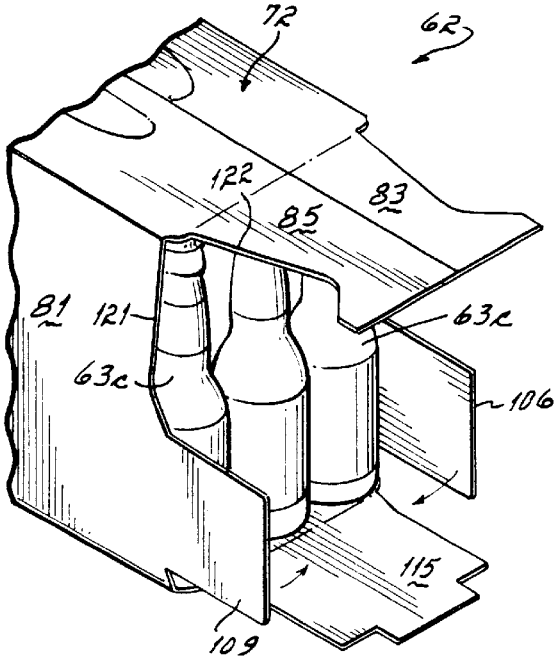
FIG. 20 is a perspective view of the sleeve style long neck bottle carton shown in FIG. 12 with a long neck bottle matrix installed therein prior to closure of the carton.
Figure 21:
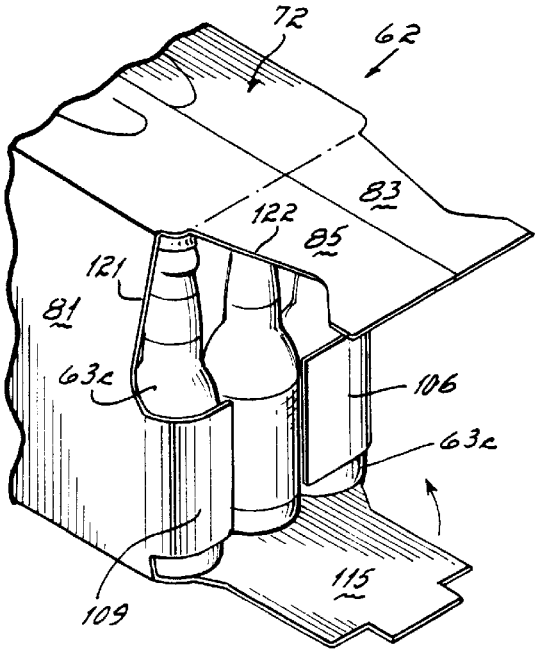
FIG. 21 is a partial perspective view similar to FIG. 20 but illustrating a first intermediate closure step of one end of the long neck bottle carton.
Figure 22:
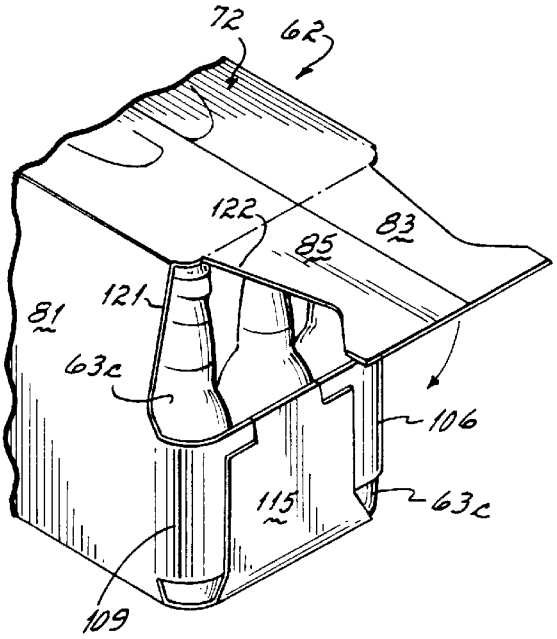
FIG. 22 is a partial perspective view similar to FIG. 21 but illustrating a second intermediate closure step of that same one end of the long neck bottle carton.
Figure 23:
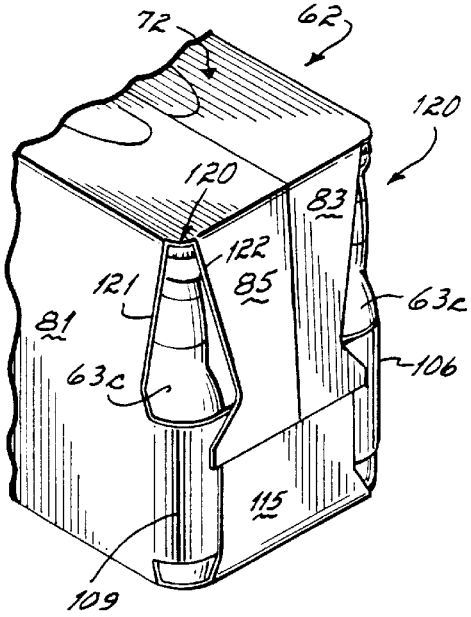
FIG. 23 is a partial perspective view similar to FIG. 22 but illustrating final closure of that one end of the long neck bottle carton.
Figure 24:
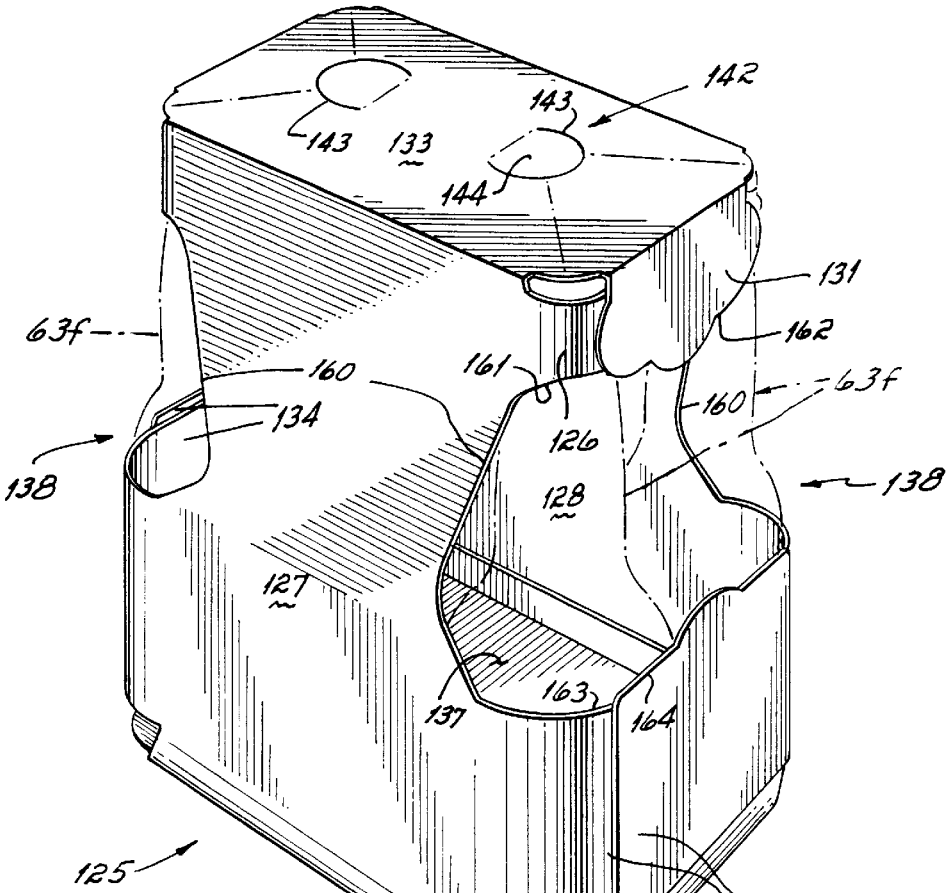
FIG. 24 is a perspective view of a third embodiment of a sleeve style carton in accord with the principles of this invention, same being illustrated in final or assembled or package form with a bottle matrix of long neck bottles.
Figure 25:
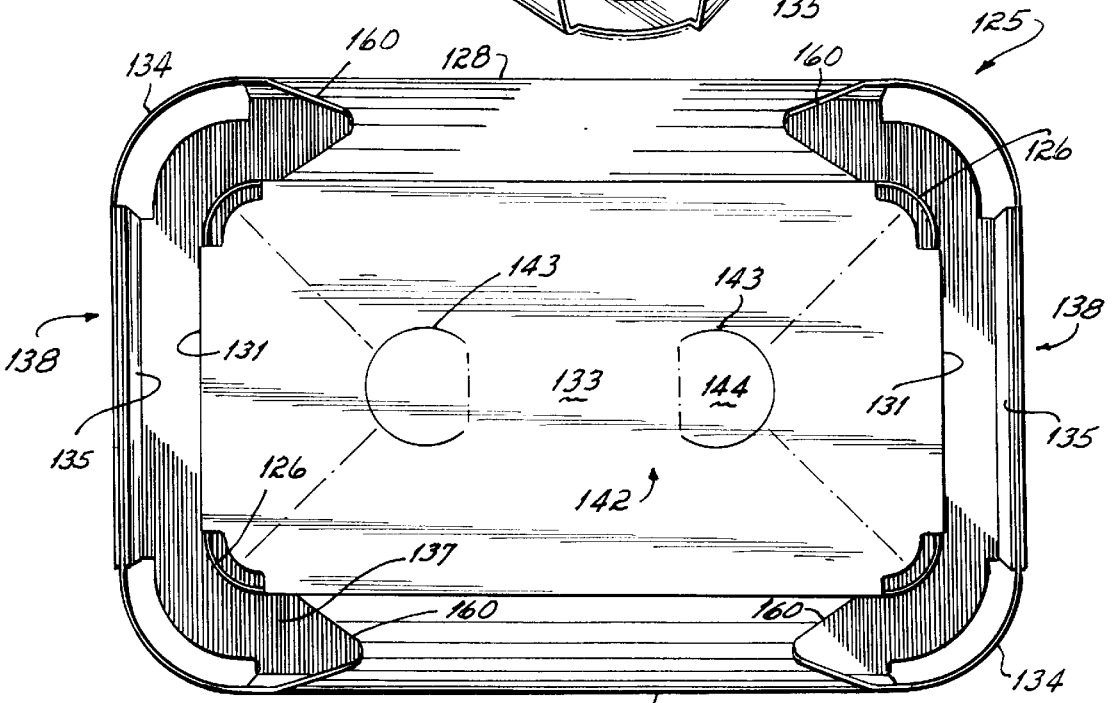
FIG. 25 is a top plan view of the long neck bottle carton of FIG. 24.
Figure 26:
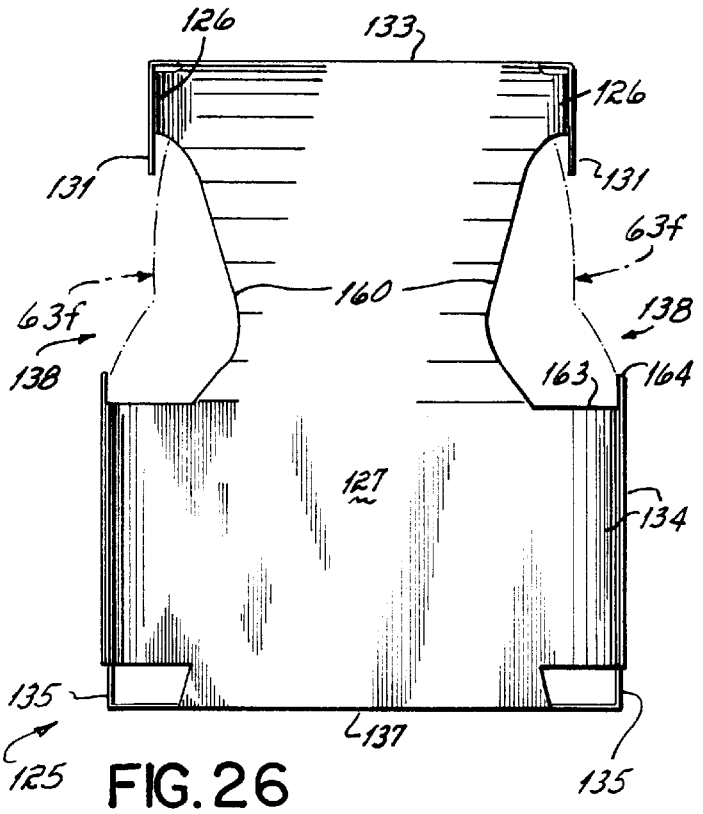
FIG. 26 is a side elevation view of the long neck bottle carton of FIG. 24.

A sleeve style carton blank 70 adapted for use with a bottle matrix 71 of bottles 63, is illustrated in FIG. 17. The blank 70 includes a head panel 72 having first 73 and second 74 top wall sections. A primary compound panel 75 is foldably connected along one edge 76 to the first top wall section 73 and foldably connected along an opposite edge 77 to the second top wall section 74, the foldable connections 76, 77 of the primary compound panel with the top wall sections 73, 74 being parallel to the foldable connections 78, 79 of the head panel 72 with opposed first 80 and second 81 side wall panels, respectively. A first head end flap panel 83, 84 is foldably connected to the first top wall section 73 at each end of the head panel 72, respectively, and a second head end flap panel 85, 86 is foldably connected to the second top wall section 74 at each end of the head panel, respectively. A secondary compound panel 87, 88 is foldably connected between each pair 83, 85 and 84, 86 of the first and second head end flap panels, respectively, each secondary compound panel 87, 88 being foldably connected along one edge 89 to the first head end flap panel 83, 84 and foldably connected along an opposite edge 90 to its associated second head end flap panel 85, 86. The foldable connection 89 of each secondary compound panel 87, 88 with its associated first head end flap panel 83, 84 is co-linear with that foldable connection 76 of the primary compound panel 75 with the first top wall section 73, and the foldable connection 90 of each secondary compound panel 87, 88 with its associated second head end flap panel 85, 86 is co-linear with that foldable connection 77 of the primary compound panel 75 with the second top wall section 74. Thus, the primary 75 and secondary 87, 88 compound panels are oriented in line one with the other. Relief holes 91*a*, 92*a* are provided on the fold lines 91, 92 between the head end flap panels 83, 85 and 84, 86 and the first 73 and second 74 top wall sections, respectively.

The head panel 73, 74 also includes a handle system 95 which includes D-shaped hand holes 96 oriented in mirror relation relative one to the other in the first 73 and second 74 top wall sections. Each handle hole 96 is defined by cut lines, and is foldably connected to its respective top wall section by fold line 97. Each handle flap 98 is provided with cut lines 99 and fold lines 100 so as to make easier its tear out from the respective top wall section 73 or 74 during use. The head panel 73 further includes a tear out panel 101 that is also partially formed in the first side wall panel 80. This tear out panel 101, which is defined by serrated lines 102 that end at one of the handle holes, allows a user to tear same away from the bottle matrix 71 filled carton 62 so as to enhance removal of bottles 63 from that carton.

The first side wall panel 80 is foldably mounted to the first top wall section 83 along fold line 78. That first side wall panel 80 includes body corner flaps 106, 107 formed integral therewith on opposite side edges thereof. The size and location relationship of these body corner flaps 106, 107 relative to the long neck bottles 63 is the same as described above relative to the size and location of corner flaps 24, 25 for blank 20 in the first embodiment relative to the short neck bottles 11.

The carton blank 70 also includes the second side wall panel 81 that is foldably connected along fold line 79 to the second top wall section 74. This second side wall panel 81 includes body corner flaps 109, 110 which are also of a size and configuration relationship relative to the long neck bottle 63 as that of the body corner flap 37, 38 size and configuration relative to the short neck bottle 11.

The carton blank 70 further includes a floor panel 112 foldably connected along fold line 113 to the bottom edge of the second side wall panel 81, the floor panel having a secondary fold line 113*a* and a glue flap 114 foldably connected on line 114*a* to the opposite side thereof. Floor end flap panels 115, 116 are foldably connected along lines 117, 118 respectively to opposite ends of the floor panel.

In use, and as illustrated in FIGS. 18–23, the first 73 and second 74 top wall sections are first folded or overlapped relative one to the other using the compound panel 75, and glued together along that compound panel 75 so as to provide a reinforced handle system 95. Next, the blank 70 has glue applied to the glue flap 114 and the floor panel 112 is folded under along score line 113*a*, then the first side wall panel 80 is folded under along the score line 78 to glue the bottom edge 119 to the glue flap 114. This provides an intermediate step in which the carton blank 70 is established in sleeve form or configuration of FIG. 18, but still can lie flat for shipping purposes. Once the flattened sleeve carton reaches the bottler, then same is erected into that configuration illustrated in FIG. 19, and the long neck bottles 63 inserted into that sleeve as a bottle matrix 71. Subsequently the body corner flaps 106, 107, 109, 110 are relatively tightly wrapped around the bodies of the corner bottles 63*c* so that the bottles interiorly of the carton are held relatively tightly against one another.

Thereafter the floor end flap panels 115, 116 are folded up and glued to the body corner flaps 106, 107, 109, 110, and subsequently the head end flap panels 83, 85 and 84, 86 are folded down and glued against the floor end flap panels 115, 116 so as to create the final package or carton. Note that the head 83, 85 and 84, 86 and floor 115, 116 end flap panels in this second embodiment are connected to each other, and to the body corner flaps 106, 107, 109, 110, to effect closure of the closed end carton. Here in this second embodiment the windows 120 by which the corner bottles 63*c* are viewed, as to the shoulder 64*a*, neck 65 and head 66 of each corner bottle, are defined by edges 121 of the side wall panels 80, 81 and edges 122 of the head end flap panels 83, 85 and 84, 86 when the corner bottles are viewed in side elevation view and end elevation view.

A third embodiment of a sleeve style carton 125 of this invention, and also particularly structured for use with a long neck bottle 63, e.g., a beer bottle, is illustrated in FIGS. 24–34. This long neck bottle 63 is of the same type illustrated in FIG. 13, and described above.

The sleeve style carton 125 of this embodiment is particularly characterized in the use of a head corner flap 126 formed integral with each side wall panel 127, 128 at each end 129 of each side wall panel, each head corner flap being wrapped around a head 66 of a corner bottle 63*f* in the carton 125. Each head corner flap 126 is of a height HCFH not substantially greater than the height HBH of its associated corner bottle's head 63*f*, and is positioned so as to substantially overlie the corner bottle's head 66 when the carton 125 is filled with a bottle 71 matrix. This allows the associated corner bottle's neck 65 and shoulder 64 to be at least partially visible when the carton 125 is filled with the bottle 63 matrix and is viewed in end elevation view.

Head end flap panels 131 are foldably connected to opposed ends 132 of the head panel 133. Those head end flap panels 131 are also connected or glued to the head corner flaps 126 at each end of the carton 125 to effect closure of the carton adjacent the head panel 133 of the carton.

Body corner flaps 134 are also formed integral with each side wall panel 127, 128 at each end 129 of each side wall panel. Each body corner flap 134 is wrapped around a body 64 of a corner bottle 63*f* to draw all bottles 63 in the bottle matrix against one another when the carton 125 is filled with the bottle matrix. Each body corner flap 134 preferably, and as described above, is of a height BFH not substantially greater than the height BH of its associated corner bottle's body 64, and is positioned so as to at least partially overlie the corner bottle's body when the carton 125 is filled with the bottle 63 matrix. This also allows the corner bottle's neck 65 and shoulder 64 to be at least partially visible when the carton 125 is filled with the bottle 63 matrix and is viewed in end elevation view. Floor end flap panels 135 are foldably connected to opposed ends 136 of the floor panel 137. The floor end flap panels 135 are connected by gluing to the body corner flaps 134 at each end of the carton 125 to effect closure of the carton adjacent the floor panel of the carton.

Figure 27:
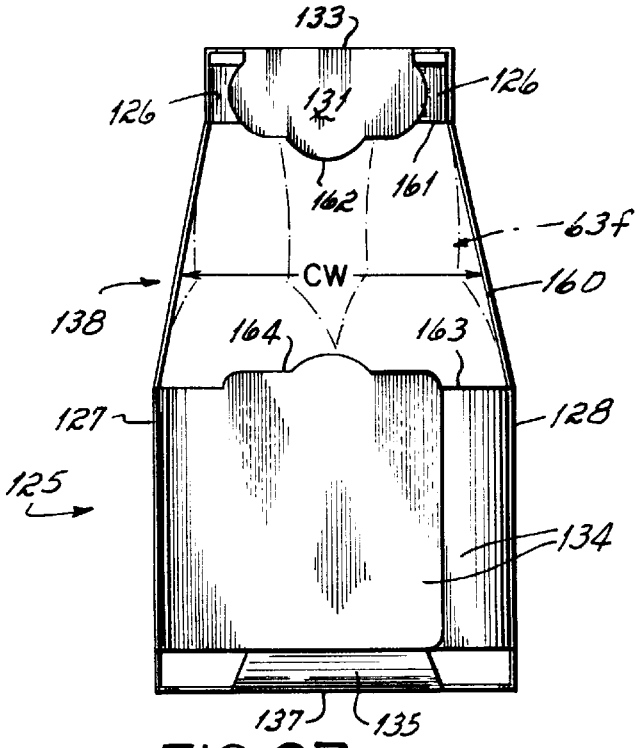
FIG. 27 is an end elevation view of the long neck bottle carton of FIG. 24.

This carton 125 structure of head corner flaps 126 and head end flap panel 131 on the one hand, and body corner flaps 134 and floor end flap panel 135 on the other hand, is configured and located so as to define a window 138 at each end of the carton through which the corner bottles' neck 65 and shoulder 64 portions can be seen when the carton is viewed in end elevation view. Indeed, and particularly, this structure is configured and located to establish a window 138 between the head corner flaps 126 and head end flap panel 131 on the one hand, and body corner flaps 134 and floor end flap panel 135 on the other hand, that extends across the entire width CW of the carton 125 and through which the necks 65 and shoulders 64 of all bottles 63 at each end of the carton 125 can be seen when the carton is viewed in end elevation view (FIG. 27).

Figure 28:
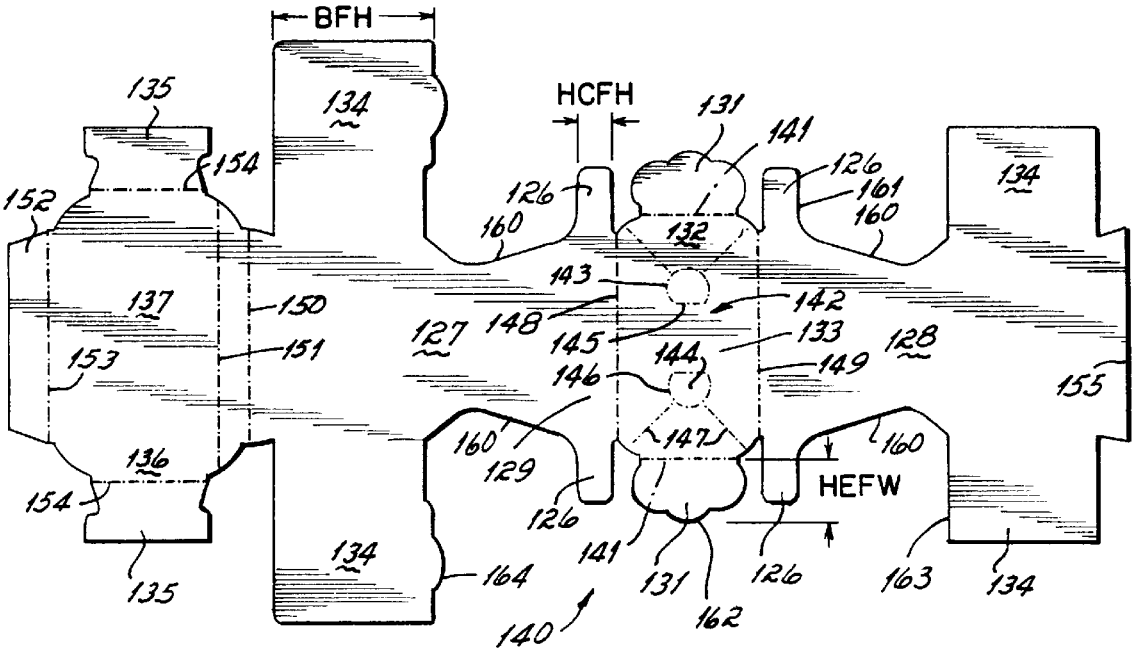
FIG. 28 is a top plan view of a carton blank for the sleeve style long neck bottle carton of FIG. 24, and in accord with the principles of this invention.

A sleeve style carton blank 140 adapted for use with a bottle 63 matrix of long neck bottles is illustrated in FIG. 28. The carton blank 140 includes the head panel 133 with head end flap panel 131 foldably connected on fold line 141 to each end of the head panel. Each head end flap panel 131 is of a width HEFW substantially equal to the height HCFH of its associated head corner flaps 126. The head panel 133 also includes a handle system 142 defined by spaced finger holes 143. Each finger hole 143 is defined by a finger hole flap 144 foldably connected on fold line 145 to the head panel 133, and separable therefrom on curved cut line 146. Stress relief score lines 147 are provided in the head panel 133, and each such stress relief score line runs from a corner of the head panel to a finger hole 143.

The first side wall panel 127 is foldably mounted to the head panel 133 along fold line 148. That first side wall panel 127 includes body corner flaps 134 formed integral therewith at opposite ends thereof. The size and location relationship of these body corner flaps 134 relative to the long neck bottles 63 is the same as described above relative to the size and location of corner flaps 106, 107, 109, 110 for carton blank 70 in the second carton embodiment disclosed herein. The carton blank 140 also includes the second side wall panel 128 that is foldably connected along fold line 149 to the head panel 133. This second side wall panel 128 also includes body corner flaps 134 which are also the same in size and configuration relative to the long neck bottle 63 as that of the body corner flap 106, 107, 109, 110 size and configuration described in the second carton embodiment. The carton blank 140 further includes the floor panel 137 which is foldably connected along fold line 150 to the bottom edge of the first side wall panel 127, the floor panel having a secondary fold line 151 and a glue flap 152 foldably connected on line 153. Floor end flap panels 135 are foldably connected along lines 154 to opposite ends of the floor panel 137.

Figure 29:
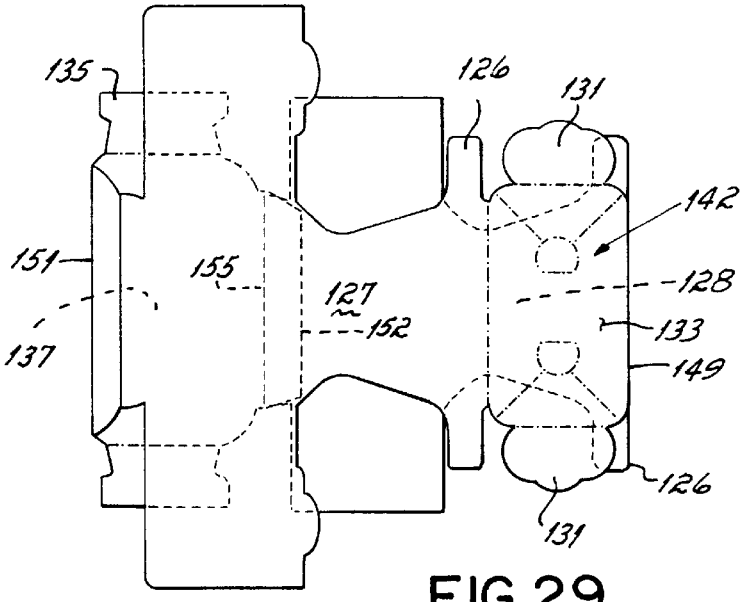
FIG. 29 is a top plan view of the carton blank in an intermediate assembly step where it is glued into sleeve configuration but is still flattened for shipping.
Figure 30:
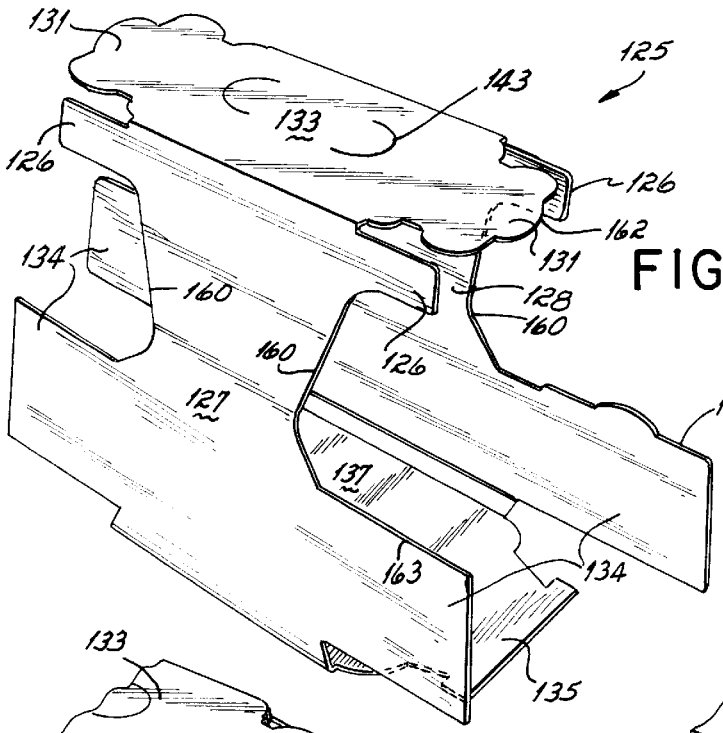
FIG. 30 is a perspective view of the erected sleeve of FIG. 29.
Figure 31:
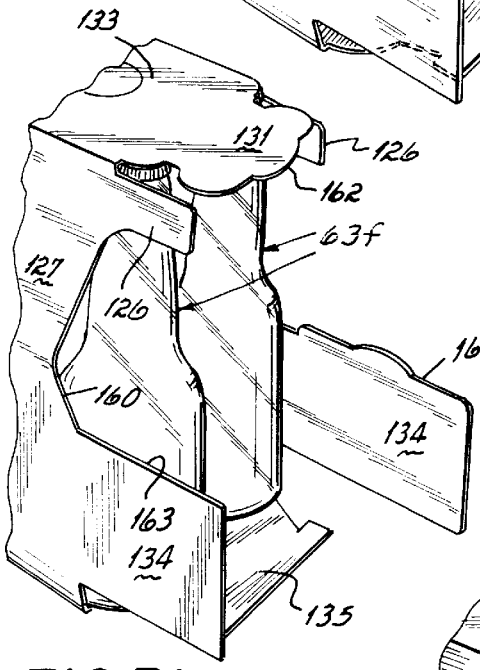
FIG. 31 is a perspective view of the sleeve style long neck bottle carton shown in FIG. 24 with a long neck bottle matrix installed therein prior to closure of the carton.
Figure 32:
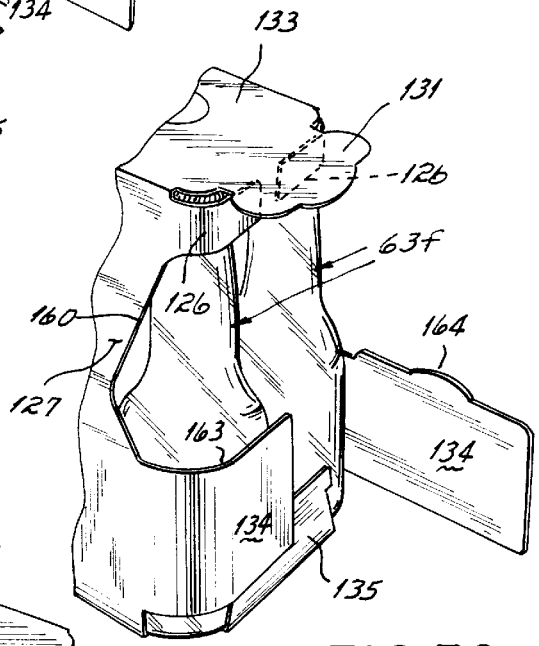
FIG. 32 is a partial perspective view similar to FIG. 31 but illustrating a first and second intermediate closure step of one end of the long neck bottle carton.
Figure 33:
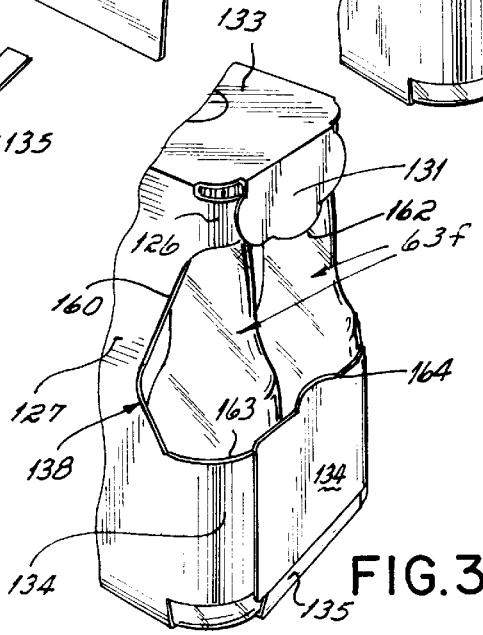
FIG. 33 is a partial perspective view similar to FIG. 32 but illustrating final closure of that one end of the long neck bottle carton.

In use, and as illustrated in FIG. 29, the carton blank 140 has glue applied to the glue flap 152 and the floor panel 137 is folded under along secondary score line 151. Then the second side wall panel 128 is folded over along score line 149 to glue its bottom edge 155 to the glue flap 152. This provides an intermediate step in which the carton blank 140 is established in sleeve form as shown in FIG. 30, but still can lie flat for shipping purposes. Once the flattened sleeve carton reaches the bottler, then same is erected into that configuration illustrated in FIG. 30, and the long neck bottles 63 inserted into that sleeve as a bottle matrix. Subsequently, as seen in FIGS. 32 and 33, floor end flaps 135 are folded upwardly, then the body corner flaps 134 are relatively tightly wrapped around the corner bottles 63*f* and glued so that the bottles interiorly of the carton are held relatively tightly against one another. And the head corner flaps 126 are wrapped around the heads 66 of the corner bottles 63*f* so that the bottle heads are held interiorly of the carton 125 package. Thereafter, the head end flap panels 131 are folded down and glued against the head corner flaps 126, so as to create the final package or carton. Here in this third carton 125 embodiment, the windows 138 by which the corner bottles 63*f* are viewed, as to the corner bottles' shoulders 64 and necks 65, are defined by edges 160 of the side wall panels 127, 128, by edges 161, 162 of the head corner flaps 126 and head end flap panel 131, and by edges 163, 164 of the body corner flaps 134, when the end bottles 63*f* in the carton 125 package are viewed in end elevation view.

Having described in detail the preferred embodiment of our invention, what we desire to claim and protect by Letters Patent is:

1. A sleeve style closed end carton for packaging a bottle matrix, said matrix having a corner bottle at each corner of said matrix, each corner bottle having a head, a neck, a shoulder, a body, and a heel, each corner bottle having a label section on which is provided a label, said carton comprising head, floor and opposed side wall panels, said panels being foldably connected one to the other, and each of said wall panels having opposed ends, a body corner flap formed integral with each side wall panel at each end of each side wall panel, each body corner flap being wrapped around a body of a corner bottle to draw all bottles in a bottle matrix against one another in a packaged configuration when said carton is filled with a bottle matrix, each body corner flap being of a height not substantially greater than the height of a corner bottle's label and being configured and positioned so as to substantially overlie only a corner bottle's label when said carton is filled with a bottle matrix, and a corner bottle's neck and shoulder being at least partially visible when said carton is filled with a bottle matrix and is viewed in side or end elevation view, flap label indicia provided on at least one body corner flap that simulates a portion of bottle label indicia provided on a bottle's label, and end flap panels foldably connected to opposed ends of at least one of said head and floor panels, said end flap panels being connected to said body corner flaps at each end of said carton to effect closure of said carton.

2. A carton as claimed in claim 1, said flap label indicia being visually distinct from graphics on its adjacent end and side wall panels.

3. A carton as claimed in claim 1, said carton comprising corner structure defined by said head panel, said corner structure being configured proximately to overlie but not extend substantially beyond a packaged corner bottle's head so that at least a packaged corner bottle's shoulder is partially visible when said carton is filled with a bottle matrix and is viewed in top plan view.

4. A carton as claimed in claim 1, said flap label indicia simulating that portion of bottle label indicia that is visible when a bottle's label is viewed on a bottle in front plan view.

5. A carton as claimed in claim 4, said flap label indicia length being of a length no greater than about one-quarter the peripheral length of a bottle.

6. A carton as claimed in claim 4, a corner bottle's heel also being partially visible when said carton is filled with a bottle matrix and is viewed in side or end elevation view.

7. A carton as claimed in claim 1, said carton comprising a side end flap panel formed integral with a body corner flap at one end of said carton, said side end flap panel being connected to a floor end flap panel to cooperate in effecting closure of said carton, the top edges of said side and floor end flap panels not extending substantially above the top edges of said body corner flaps, that end of said carton thereby establishing a window above said body corner flaps that extends across the width of said carton and through which necks and shoulders of all bottles at that end of said carton can be seen when said carton is viewed in end elevation view from that end.

8. A carton as claimed in claim 1, said carton comprising head and floor end flap panels foldably connected to said head and floor panels, respectively, at one end of said carton, said head and floor end flap panels being connected to each other and to said body corner flaps to cooperate in effecting closure of said carton, the end edges of said side wall panels and said end flap panels being configured to show neck and shoulder portions of each corner bottle at the end of said carton when said carton is viewed in end elevation view from that end.

9. A combination sleeve style closed end carton and bottle matrix, said matrix having a corner bottle at each corner of said matrix, each corner bottle having a head, a neck, a shoulder, a body, and a heel, each corner bottle having a label section on which is provided a label, said carton comprising head, floor and opposed side wall panels, said panels being foldably connected one to the other, and each of said wall panels having opposed ends, a body corner flap formed integral with each side wall panel at each end of each side wall panel, each body corner flap being wrapped around a body of a corner bottle to draw all bottles in a bottle matrix against one another in a packaged configuration when said carton is filled with a bottle matrix, each body corner flap being of a height not substantially greater than the height of a corner bottle's label and being configured and positioned so as to substantially overlie only a corner bottle's label when said carton is filled with a bottle matrix, and a corner bottle's neck and shoulder being at least partially visible when said carton is filled with a bottle matrix and is viewed in side or end elevation view, flap label indicia provided on at least one corner flap that simulates a portion of bottle label indicia provided on a bottle's label, and end flap panels foldably connected to opposed ends of at least one of said head and floor panels, said end flap panels being connected to said body corner flaps at each end of said carton to effect closure of said carton.

10. A carton blank for a sleeve style closed end carton used for packaging a bottle matrix, said matrix having a corner bottle at each corner of said matrix, and each corner bottle having a head, a neck, a shoulder, a body, and a heel, and each corner bottle having a label section on which is provided a label, said carton blank comprising head, floor and opposed side wall panels, said panels being foldably connected one to the other, and each of said wall panels having opposed ends, a body corner flap formed integral with each side wall panel at each end of each side wall panel, each body corner flap being wrapped around a body of a corner bottle to draw all bottles in a bottle matrix against one another in a packaged configuration when said carton is filled with a bottle matrix, each body corner flap being of a height not substantially greater than the height of a corner bottle's label and being configured and positioned so as to substantially overlie only a corner bottle's label when said carton is filled with a bottle matrix, and a corner bottle's neck and shoulder being at least partially visible when said carton is filled with a bottle matrix and is viewed in side or end elevation view, flap label indicia provided on at least one body corner flap that simulates a portion of bottle label indicia provided on a bottle's label, and end flap panels foldably connected to opposed ends of at least one of said head and floor panels, said end flap panels being connected to said body corner flaps at each end of said carton to effect closure of said carton.

11. A carton blank as claimed in claim 10, said flap label indicia being visually distinct from graphics on its adjacent end and side wall panels.

12. A carton blank as claimed in claim 10, said flap label indicia simulating that portion of a bottle label indicia that is visible when a bottle's label is viewed on a bottle in front plan view.

13. A carton blank as claimed in claim 12, said flap label indicia length being of a length no greater than about one-quarter the peripheral length of a bottle.

14. A carton blank as claimed in claim 12, said corner bottle's heel also being partially visible when said carton is filled with said bottle matrix and is viewed in side or end elevation view.

15. A carton blank as claimed in claim 10, said carton blank comprising a side end flap panel formed integral with a body corner flap at one end of said carton, said side end flap panel being connected to a floor end flap panel to cooperate in effecting closure of said carton, the top edges of said side and floor end flap panels not extending substantially above the top edges of said body corner flaps, that end of said carton thereby establishing a window above said body corner flaps that extends across the width of said carton and through which necks and shoulders of all bottles at that end of said carton can be seen when said carton is viewed in end elevation view from that end.

16. A carton blank as claimed in claim 10, said carton blank comprising head and floor end flap panels foldably connected to said head and floor panels, respectively, at one end of said carton, said head and floor end flap panels being connected to each other and to said body corner flaps to cooperate in effecting closure of said carton, the end edges of said side wall panels and said end flap panels being configured to show neck and shoulder portions of each corner bottle at the end of said carton when said carton is viewed in end elevation view from that end.

17. A carton blank as claimed in claim 10, said carton blank comprising corner structure defined by said head panel, said corner structure being configured proximately to overlie but not extend substantially beyond a packaged corner bottle's head so that at least a packaged corner bottle's shoulder is partially visible when said carton is filled with a bottle matrix and is viewed in top plan view.

18. A sleeve style closed end carton for packaging a bottle matrix, said matrix having a corner bottle at each corner of said matrix, each corner bottle having a head, a neck, a shoulder and a body, said carton comprising head, floor and opposed side wall panels, said panels being foldably connected one to the other, and each of said wall panels having opposed ends, a head corner flap formed integral with each side wall panel at each end of each side wall panel, each head corner flap being wrapped around and abutting a head of a corner bottle, each head corner flap being of a height not substantially greater than the height of a corner bottle's head and being configured and positioned so as to substantially overlie a corner bottle's head when said carton is filled with a bottle matrix, and a corner bottle's neck and shoulder being at least partially visible when said carton is filled with a bottle matrix and is viewed in end elevation view, and end flap panels foldably connected to opposed ends of said head panel, said head end flap panels being connected to said head corner flaps at each end of said carton to effect closure of said carton.

19. A carton as claimed in claim 18, said carton comprising corner structure defined by said head panel, said corner structure being configured proximately to overlie but not extend substantially beyond a packaged corner bottle's head so that at least a packaged corner bottle's shoulder is partially visible when said carton is filled with a bottle matrix and is viewed in top plan view.

20. A carton a s claimed in claim 18, said carton comprising a body corner flap formed integral with each side wall panel at each end of each side wall panel, each body corner flap being wrapped around a body of a corner bottle to draw all bottles in a bottle matrix against one another in a packaged configuration when said carton is filled with a bottle matrix, each body corner flap being of a height not substantially greater than the height of a corner bottle's body and being configured and positioned so as to at least partially overlie a corner bottle's body when said carton is filled with bottle matrix, and a corner bottle's neck and shoulder being at least partially visible when said carton is filled with a bottle matrix and is viewed in end elevation view, and floor end flap panels foldably connected to opposed ends of said floor panels, said floor end flap panels being connected to said body corner flaps at each end of said carton to effect closure of said carton, said head corner flaps, head end flap panels, body corner flaps and floor end flap panels being configured and located so as to define a window at each end of said carton through which corner bottles' neck and shoulder portions can be seen when said carton is viewed in end elevation view.

21. A carton as claimed in claim 20, said side wall panels, head and body corner flap panels, and head and floor end flap panels being configured to establish a window between said head corner flaps and head end flap panel, and said body corner flaps and floor end flap panel, that extends across the entire width of said carton and through which necks and shoulders of all bottles at each end of said carton can be seen when said carton is viewed in end elevation view.

22. A carton as claimed in claim 21, said carton comprising a side end flap panel formed integral with a body corner flap at one end of said carton, said side end flap panel being connected to said floor end flap panel to cooperate in effecting closure of said carton, the top edge of said side and floor end flap panels not extending substantially above the top edges of said body corner flaps.

23. A carton as claimed in claim 18, said head panel having a length not substantially greater than the length of a bottle line of a bottle matrix as measured from outer edge to outer edge of bottle caps on those two bottles at opposite ends of the bottle line, and having a width not substantially greater than the width of a bottle row of a bottle matrix as measured from outer edge to outer edge of bottle caps on those two bottles at opposite ends of the bottle row, and said floor panel having a length not substantially greater than the length of a bottle line of a bottle matrix as measured from outer edge to outer edge of bodies of those two bottles at opposite ends of the bottle line, and having a width not substantially greater than the width of a bottle row of a bottle matrix as measured from outer edge to outer edge of bodies of those two bottles at opposite ends of the bottle row, which said floor panel length and width is substantially greater than said head panel length and width.

24. A carton as claimed in claim 23, each side wall panel having a necked down length at an elevation adjacent a corner bottle's shoulder that is less than the length of said side wall panel adjacent said head panel and that is less than the length of said side wall panel adjacent said floor panel, thereby enlarging the view of each visible corner bottle's neck and shoulder over that which otherwise would be the case if said necked down length did not exist.

25. A carton blank for a sleeve style closed end carton for packaging a bottle matrix, said matrix having a corner bottle at each corner of said matrix, each corner bottle having a head, a neck, a shoulder, and a body, said carton blank comprising head, floor and opposed side wall panels, said panels being foldably connected one to the other, and each of said wall panels having opposed ends, a head corner flap formed integral with each side wall panel at each end of each side wall panel, each head corner flap being configured to wrap around and abut a head of a corner bottle, each head corner flap being of a height not substantially greater than the height of a corner bottle's head and being configured and positioned so as to substantially overlie a corner bottle's head when said carton is filled with a bottle matrix, and a corner bottle's neck and shoulder being at least partially visible when said carton is filled with a bottle matrix and is viewed in end elevation view, and head end flap panels foldably connected to opposed ends of said head panel, said head end flap panel being connected to said head corner flaps at each end of said carton to effect closure of said carton.

26. A carton blank as claimed in claim 25, said carton blank comprising corner structure defined by said head panel, said corner structure being configured proximately to overlie but not extend substantially beyond a packaged corner bottle head so that at least a packaged corner bottle's shoulder is partially visible when said carton is filled with a bottle matrix and is viewed in top plan view.

27. A carton blank as claimed in claim 25, said carton blank comprising a body corner flap formed integral with each side wall panel at each end of each side wall panel, each body corner flap being wrapped around a body of a corner bottle to draw all bottles in a bottle matrix against one another in a packaged configuration when said carton is filled with a bottle matrix, each body corner flap being of a height not substantially greater than the height of a corner bottle's body and being configured and positioned so as to at least partially overlie a corner bottle's body when said carton is filled with a bottle matrix, and a corner bottle's neck and shoulder being at least partially visible when said carton is filled with a bottle matrix and is viewed in end elevation view, and floor end flap panels foldably connected to opposed ends of said floor panel, said floor end flap panels being connected to said body corner flaps at each end of said carton to effect closure of said carton, said head corner flap, head end flap panels body corner flaps and floor end flap panel being configured and located so as to define a window at each end of said carton through which corner bottles' neck and shoulder portions can be seen when said carton is viewed in end elevation view.

28. A carton blank as claimed in claim 27, said side wall panels, head and body corner flap panels, and head and floor end flap panels being configured to establish a window between said head corner flaps and head end flap panel, and said body corner flaps and floor end flap panel, that extends across the entire width of said carton and through which necks and shoulders of all bottles at each end of said carton can be seen when said carton is viewed in end elevation view.

29. A carton blank as claimed in claim 28, said carton blank comprising a side end flap panel formed integral with a body corner flap at one end of said carton, said side end flap panel being connected to said floor end flap panel to cooperate in effecting closure of said carton, the top edge of said side and floor end flap panels not extending substantially above the top edges of said body corner flaps.

30. A sleeve style closed end carton blank as claimed in claim 25, said head panel having a length not substantially greater than the length of a bottle line of a bottle matrix as measured from outer edge to outer edge of bottle caps on those two bottles at opposite ends of the bottle line, and having a width not substantially greater than the width of a bottle row of a bottle matrix as measured from outer edge to outer edge of bottle caps on those two bottles at opposite ends of the bottle row, and said floor panel having a length not substantially greater than the length of a bottle line of a bottle matrix as measured from outer edge to outer edge of bodies of those two bottles at opposite ends of the bottle line, and having a width not substantially greater than the width of a bottle row of a bottle matrix as measured from outer edge to outer edge of bodies of those two bottles at opposite ends of the bottle row, which said floor panel length and width is substantially greater than said head panel length and width.

31. A carton blank as claimed in claim 30, each side wall panel having a necked down length at an elevation adjacent a corner bottle's shoulder that is less than the length of said side wall panel adjacent said head panel and that is less than the length of said side wall panel adjacent said floor panel, thereby enlarging the view of each visible corner bottle's neck and shoulder over that which otherwise would be the case if said necked down length did not exist.

* * * * *